US007165562B2

(12) United States Patent
Myong

(10) Patent No.: US 7,165,562 B2
(45) Date of Patent: Jan. 23, 2007

(54) WASHING DEVICE FOR A BABY BOTTLE

(76) Inventor: Jong-hyun Myong, 151-1402 Jugong APT, Hwanggol Village, Yeongton-dong, Paldal-gu, Suwon-si (KR)

( * ) Notice: Subject to any disclaimer, the term of this patent is extended or adjusted under 35 U.S.C. 154(b) by 636 days.

(21) Appl. No.: 10/476,037

(22) PCT Filed: Apr. 27, 2002

(86) PCT No.: PCT/KR02/00791

§ 371 (c)(1),
(2), (4) Date: Oct. 28, 2003

(87) PCT Pub. No.: WO02/087407

PCT Pub. Date: Nov. 7, 2002

(65) Prior Publication Data

US 2004/0123885 A1 Jul. 1, 2004

(30) Foreign Application Priority Data

| | | |
|---|---|---|
| Apr. 28, 2001 | (KR) | 2001-23155 |
| Jul. 23, 2001 | (KR) | 2001-44256 |
| Sep. 10, 2001 | (KR) | 2001-55423 |
| Apr. 27, 2002 | (KR) | 2002-23267 |

(51) Int. Cl.
*B08B 3/02* (2006.01)

(52) U.S. Cl. ..... 134/56 R; 134/166 R; 134/169 R; 134/170

(58) Field of Classification Search ..... 134/56 R, 134/57 R, 58 R, 166 R, 169 R, 200
See application file for complete search history.

(56) References Cited

U.S. PATENT DOCUMENTS

| | | | | |
|---|---|---|---|---|
| 2,340,215 A | * | 1/1944 | Fowler | 15/59 |
| RE22,832 E | * | 1/1947 | Meyerson | 422/300 |

(Continued)

FOREIGN PATENT DOCUMENTS

| | | | |
|---|---|---|---|
| DE | 31 08 854 | * | 9/1982 |

(Continued)

*Primary Examiner*—Frankie L. Stinson
(74) *Attorney, Agent, or Firm*—Volpe and Koenig, PC

(57) ABSTRACT

The present invention relates to a washing device for a baby bottle. According to the present invention, it is possible to automatically wash a bottle body, a nipple and a nipple cap of the baby bottle, and to dry and sterilize the baby bottle after washing thereof. Further, the baby bottle can be used in a convenient and sanitary manner since the baby bottle can be washed with only water, even outdoors. Furthermore, the baby bottle can be washed stably since there is provided a fixture capable of holding a bottle body or a nipple cap of the baby bottle to prevent them from being moved when the baby bottle is washed by injecting a washing liquid under high pressure. Since nozzle tube for injecting the washing liquid toward upper, middle and lower portions of the bottle body accommodated in a baby bottle washing chamber is integrally formed, the nozzle tube can be installed in a simple manner.

21 Claims, 25 Drawing Sheets

U.S. PATENT DOCUMENTS

| | | | | | |
|---|---|---|---|---|---|
| 2,484,681 | A | * | 10/1949 | Brewster | 422/303 |
| 2,610,894 | A | * | 9/1952 | Hall | 239/310 |
| 4,406,297 | A | * | 9/1983 | Walton | 134/102.3 |
| 4,544,529 | A | * | 10/1985 | Hoeck | 422/303 |
| 4,560,455 | A | * | 12/1985 | Porta et al. | 205/701 |
| 5,166,528 | A | * | 11/1992 | Le Vay | 250/455.11 |
| 5,435,036 | A | * | 7/1995 | Hedrick et al. | 15/59 |
| 5,507,060 | A | * | 4/1996 | Quimpo | 15/63 |
| 5,649,335 | A | | 7/1997 | Tye | |
| 5,903,944 | A | * | 5/1999 | Burrell | 15/65 |
| 6,146,040 | A | | 11/2000 | Dunn et al. | |
| 6,202,247 | B1 | | 3/2001 | Lorenz, Jr. | |
| 6,907,893 | B1 | * | 6/2005 | Eisenberg et al. | 134/148 |

FOREIGN PATENT DOCUMENTS

| | | | |
|---|---|---|---|
| DE | 33 32 172 | * | 3/1985 |
| GB | 2260483 | | 4/1993 |

* cited by examiner

WASHING DEVICE FOR A BABY BOTTLE

TECHNICAL FIELD

The present invention relates to a washing device for a baby bottle capable of automatically washing the baby bottle comprised of a bottle body, a nipple and a nipple cap, and more particularly, to a washing device for a baby bottle which can wash a bottle body, a nipple and a nipple cap of the baby bottle to remove foreign materials adhering to them by injecting a washing liquid mixed with water and a detergent under high pressure and then dry and sterilize them.

BACKGROUND ART

Heretofore, a bottle body, a nipple and a nipple cap of a baby bottle have been manually washed by using a scrubbing brush or a simple tool capable of scrubbing the interior of the bottle body with water and a detergent.

Although there is a dishwasher for washing tableware, it is not easy to wash the baby bottle using the dishwasher since the baby bottle is generally formed to have a deep interior.

In particular, in case a baby bottle should be washed outdoors or in a vehicle when a user stays outdoors, there is a need for a portable washing device for the baby bottle capable of washing the baby bottle in a simple manner by supplying only some water and detergent thereto. However, no portable washing device has not get commercialized.

DISCLOSURE OF INVENTION

An object of the present invention is to provide a novel washing device for a baby bottle which can automatically wash a bottle body, a nipple and a nipple cap of the baby bottle.

Another object of the present invention is to provide a washing device for a baby bottle which can dry and sterilize the baby bottle after washing thereof.

A further object of the present invention is to provide a portable washing device for a baby bottle which can wash the baby bottle in a convenient and sanitary manner by supplying only water, even outdoors.

A still further object of the present invention is to provide a washing device for a baby bottle which has a fixture capable of holding a bottle body and a nipple cap of the baby bottle, in order to prevent them from moving when they are washed with washing liquid injected at a high pressure.

A washing device for a baby bottle for achieving the above objects according to the present invention comprises a main body having a baby bottle washing chamber capable of accommodating bottle bodies, nipple caps and nipples of a plurality of baby bottles therein, and formed with a supply port for supplying a washing liquid into the baby bottle washing chamber and a drain port for draining the washing liquid to exterior thereof after washing of the baby bottles; a door installed in the main body to be opened and closed for allowing the baby bottles to be introduced into and removed from the baby bottle washing chamber; a plurality of injection nozzles installed within the baby bottle washing chamber so that the washing liquid can be injected toward the accommodated bottle bodies, nipple caps and nipples; a pump for supplying the washing liquid to the plurality of injection nozzles at a high pressure; a motor for driving the pump; a nozzle tube connecting the plurality of injection nozzles to a discharge port of the pump and installed within the baby bottle washing chamber of the main body; a washing liquid mixing chamber connected to a suction port of the pump to supply the washing liquid to the pump and having a washing liquid mixing plate therein for mixing a detergent and water supplied through a washing liquid inlet thereof; a detergent storage container connected to the washing liquid inlet of the washing liquid mixing chamber; a water tap connected to the washing liquid inlet of the washing liquid mixing chamber; a detergent adjustment valve for adjusting supply of the detergent from the detergent storage container to the washing liquid mixing chamber; a water supply adjustment valve for adjusting supply of the water from the water tap to the washing liquid mixing chamber; and a control unit for controlling operations of the motor, the detergent adjustment valve and the water supply adjustment valve individually or in a predetermined sequence.

The washing device of the present invention may further comprise a plurality of bottle body supports for holding the bottle bodies in such a state where mouths of the plurality of the bottle bodies are spaced apart by a predetermined distance from and directed to the floor of the baby bottle washing chamber, and an auxiliary support having a plane for allowing the plurality of nipples and nipple caps to be aligned in one direction and accommodated therein, wherein the plurality of nozzles includes a plurality of first nozzles installed on the floor of the main body for washing the interiors of the plurality of bottle bodies and a plurality of second nozzles for washing outer surfaces of the bottle bodies, the nipple caps and the nipples.

Further, the floor of the main body may be inclined to be raised in a direction away from the drain port so that the washing liquid can be easily drained therefrom.

Moreover, the front face of the main body may be formed with a viewing window made of material that allows view of the interior of the baby bottle washing chamber.

The plurality of first nozzles may extend above first insertion rings of the plurality of bottle body supports.

In the washing device of the present invention, some of the injection nozzles may be rotary nozzles.

Furthermore, in the washing device of the present invention, a portion of the washing liquid mixing plate may be formed with a plurality of through-holes.

Each of the bottle body supports may comprise a plurality of bottle body supporting units each of which includes a first insertion ring, a second insertion ring having a diameter larger than that of the first insertion ring, and an insertion ring supporting member for connecting the first and second insertion rings to support the first and second insertion rings with a predetermined gap therebetween in parallel. The plane of the auxiliary support for separately accommodating the nipple caps and the nipples may be divided into a plane for accommodating the nipple caps and a plane for accommodating the nipples. The plurality of the bottle body supporting units and the auxiliary support may comprise wire frames through which the injected liquid can pass, and the bottle body supporting units may be coupled integrally with the auxiliary support.

The washing device of the present invention may further comprise a bottle body escape preventer including a wire frame plate detachably seated onto the auxiliary support and a plurality of pressing bars which are formed by extending some wires of the wire frame plate and press down the bottoms of the bottle bodies.

The washing device of the present invention may further comprise a pressing wire frame which is connected to an upper surface of the wire frame plate of the bottle body escape preventer and comes into contact with the door when the door is closed, thereby pressing down the bottle body escape preventer.

The washing device of the present invention may further comprise a heater for heating air to dry the plurality of washed bottle bodies, nipple caps and nipples, a blower for blowing the heated air into the baby bottle washing chamber, and air tube for guiding the air blown by the blower into the baby bottle washing chamber. The main body may be further formed with a hole for accommodating the air tube, and the control unit may further include a function of controlling the blower and the heater.

The washing device of the present invention may further comprise an ultraviolet lamp installed within the baby bottle washing chamber of the main body to sterilize the plurality of the bottle bodies, nipple caps and nipples accommodated in the baby bottle washing chamber. The control unit may further include a function of adjusting turning on and off of the ultraviolet lamp.

The predetermined control sequence performed by the control unit may comprise the step of selecting a detergent washing process or a water washing process. The detergent washing process may comprise the steps of performing water washing by opening the water supply adjustment valve for a predetermined period of time and operating the pump, performing detergent washing by opening the water supply adjustment valve and the detergent supply adjustment valve for a predetermined period of time and operating the pump, performing again the water washing by opening the water supply adjustment valve for a predetermined period of time and operating the pump, and performing sterilization by turning on the ultraviolet lamp for a predetermined period of time. The water washing process may comprise the steps of performing water washing by opening the water supply adjustment valve for a predetermined period of time and operating the pump, performing drying by operating the heater and the blower for a predetermined period of time, and performing sterilization by turning on the ultraviolet lamp for a predetermined period of time.

The control sequence may further comprise the step of performing drying by operating the heater and the blower for a predetermined period of time between the steps of performing the water washing and the sterilization of the detergent washing process.

The control sequence may further comprise the step of performing drying by operating the heater and the blower for a predetermined period of time between the steps of performing the water washing and the sterilization of the water washing process.

The washing device of the present invention may further comprise a supply water storage container in the form of a tank capable of containing a predetermined amount of water therein which can be detachably installed onto the main body, is formed at the bottom thereof with an outlet for allowing the water to run out, and has a valve means for allowing the water contained in the supply water storage container to run out into the water tap when the supply water storage container is installed onto the main body.

The valve means of the supply water storage container may include a valve plate which is positioned within the supply water storage container, takes the shape of a disk capable of closing the outlet of the supply water storage container, and has a protrusion on a surface of the valve plate directed toward the outlet to penetrate through the outlet, and rubber packing attached around the protrusion; and a boss protruding from an inner surface of the water tap connected to the washing liquid inlet.

The washing device of the present invention may further comprise a drain water collection container in the form of a tank capable of accommodating a predetermined amount of water therein which includes an opening formed at the top thereof for receiving the washing liquid drained from the drain port of the main body and a means for allowing the drain water collection container to be detachably installed at a lower portion of the main body.

BEST MODE FOR CARRYING OUT THE INVENTION

Hereinafter, embodiments of a washing device for a baby bottle according to the present invention will be described in detail with reference to the accompanying drawings.

Figure 1:
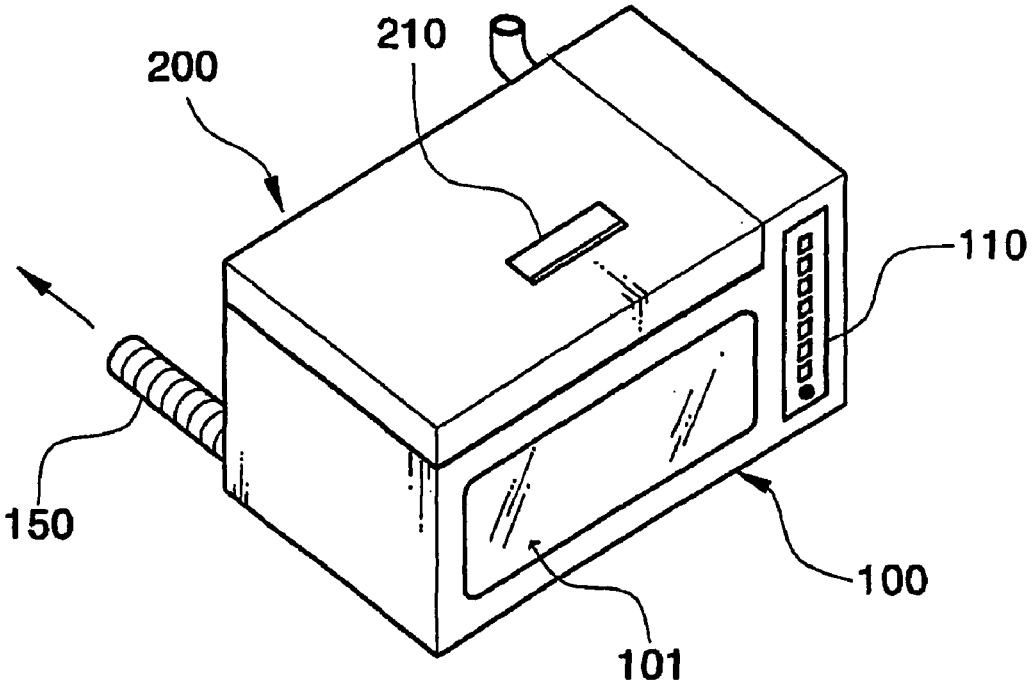
FIG. 1 is a perspective view showing an embodiment of a washing device for a baby bottle according to the present invention.
Figure 2:
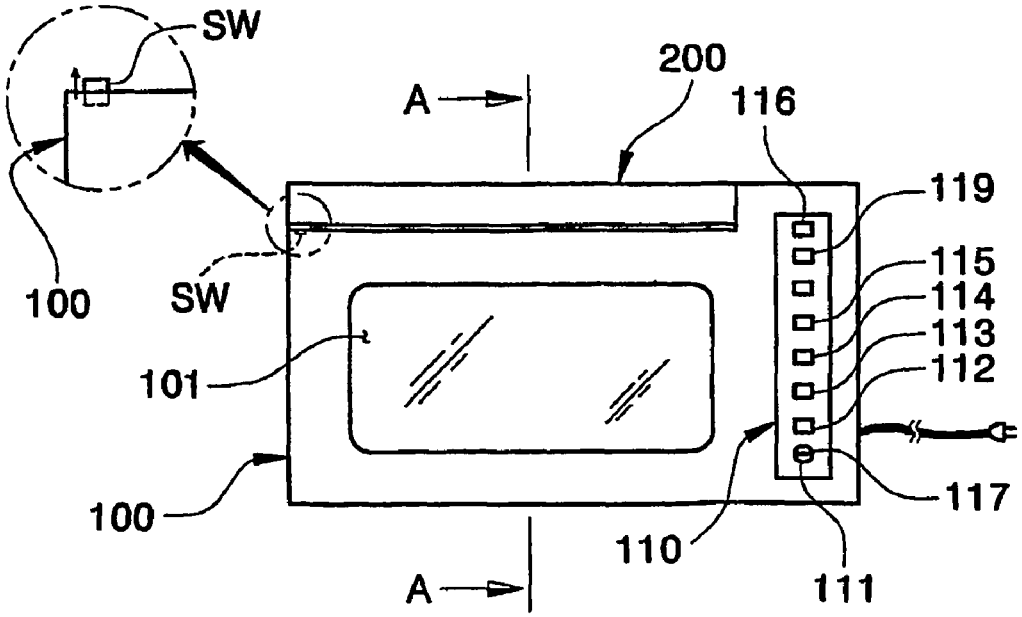
FIG. 2 is a front view of FIG. 1.
Figure 3:
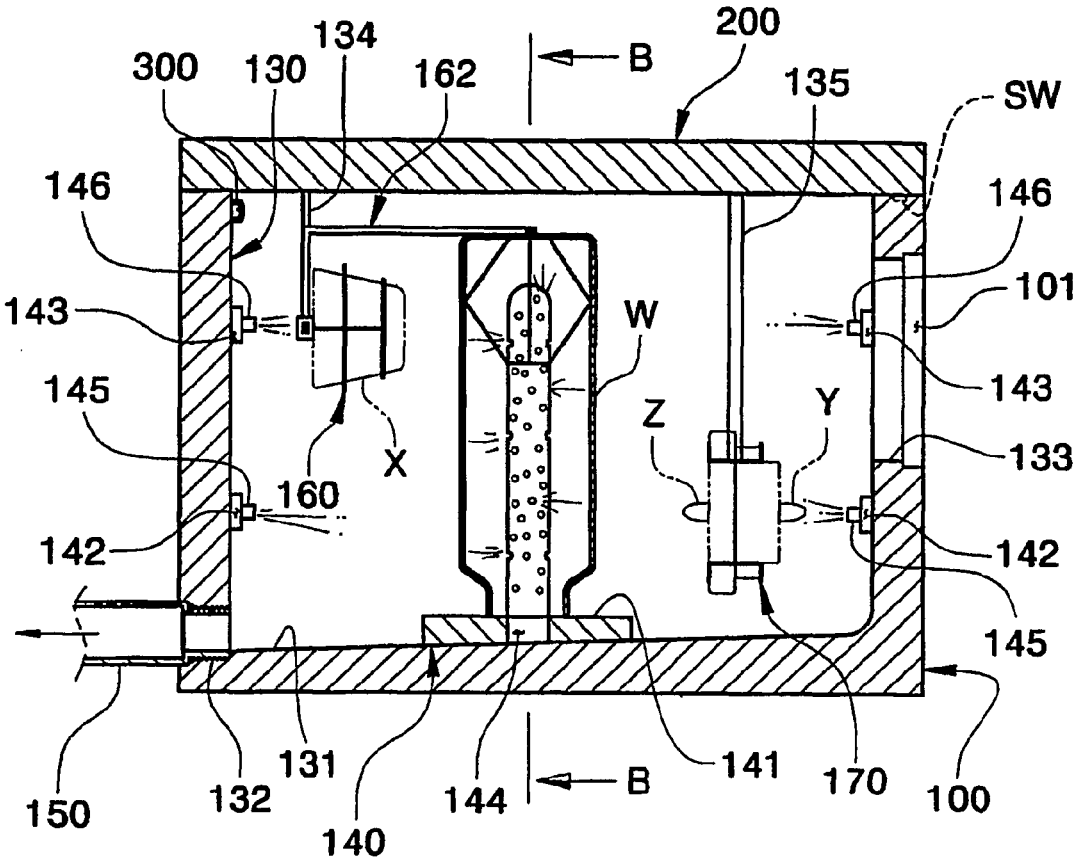
FIG. 3 is a sectional view taken along line A—A of FIG. 2.
Figure 4:
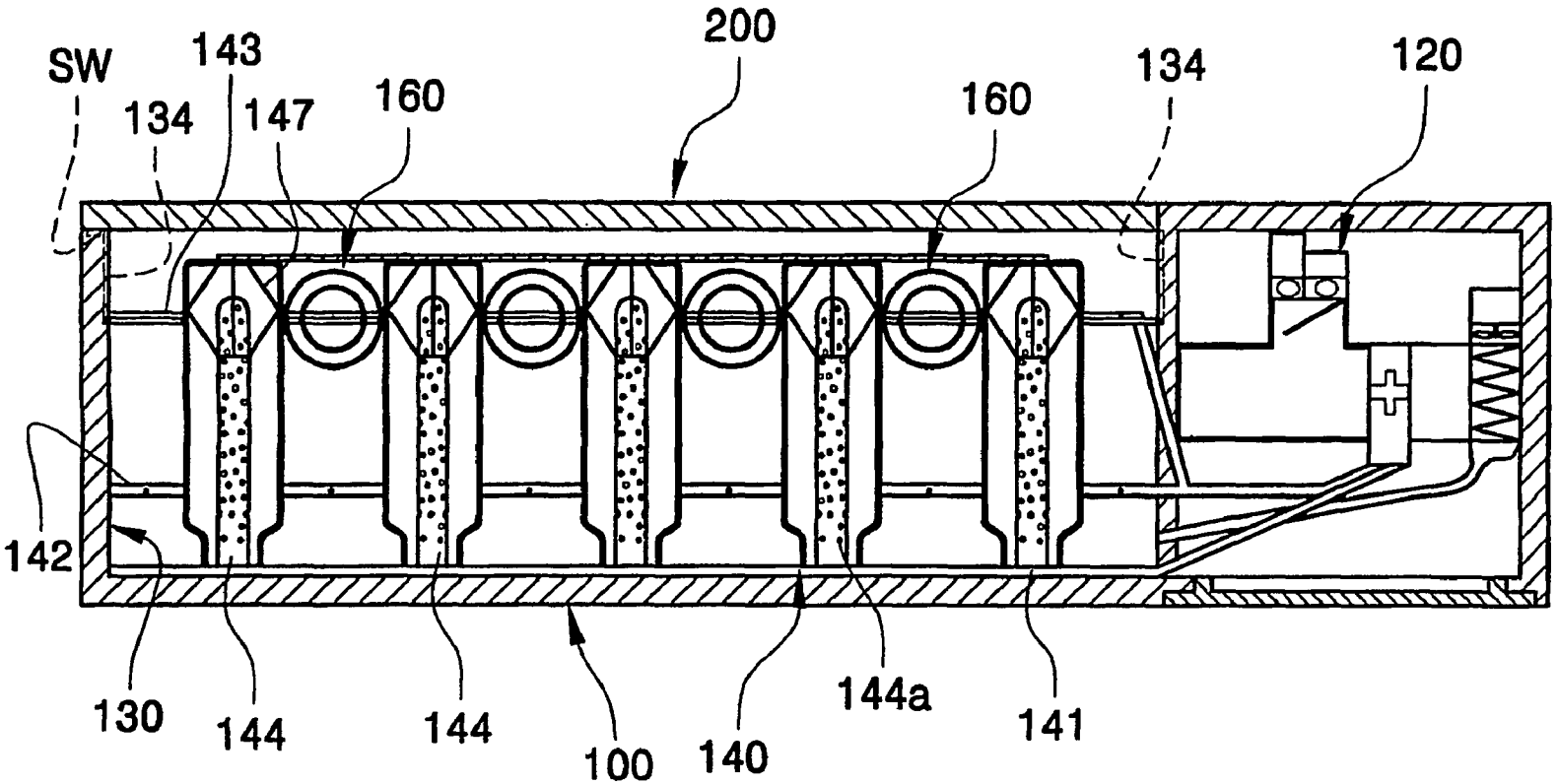
FIG. 4 is a sectional view taken along line B—B of FIG. 3.
Figure 5:
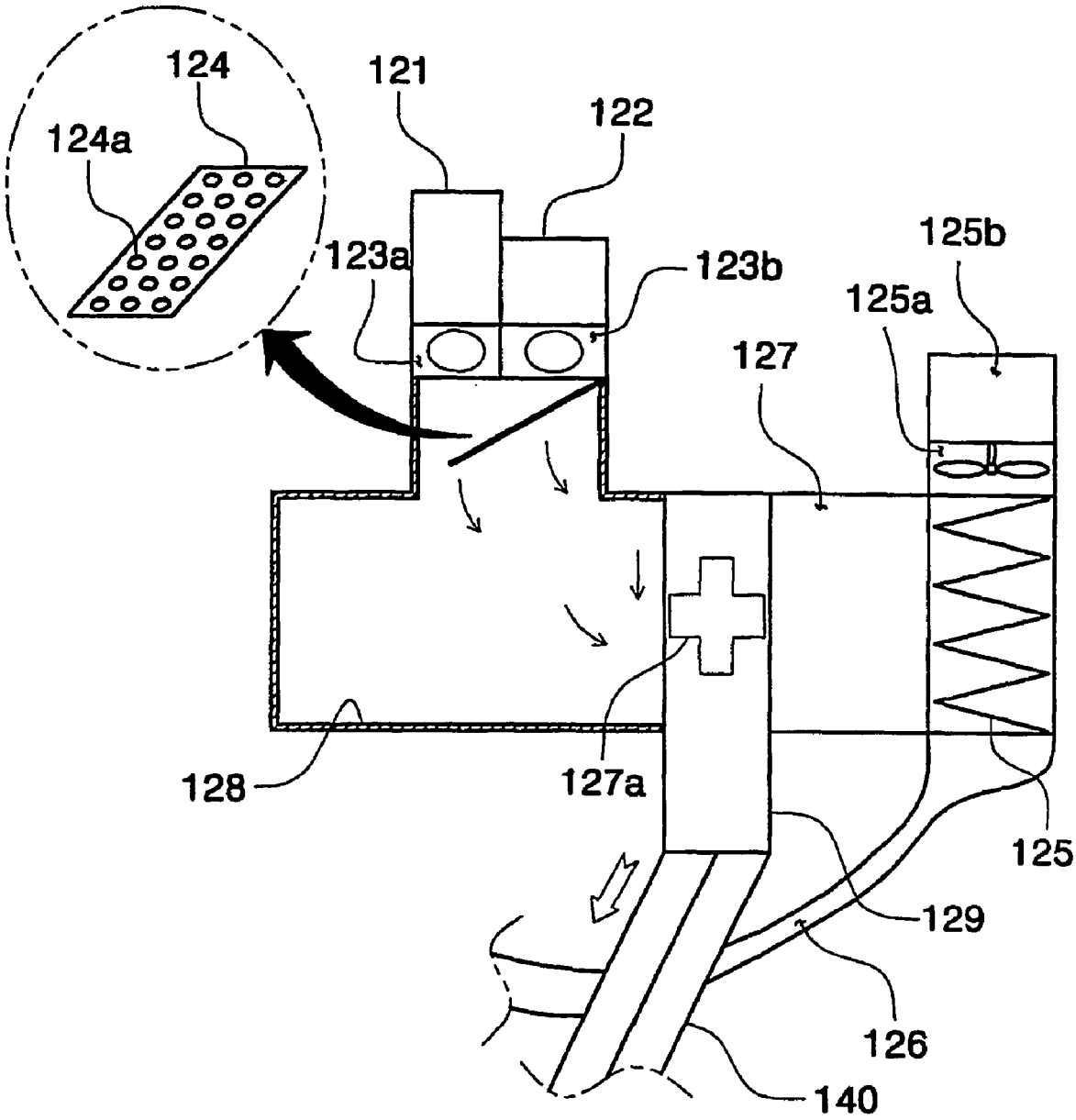
FIG. 5 is an explanatory view showing a washing drive unit of FIG. 4.

FIG. 1 is a perspective view showing an embodiment of the washing device for the baby bottle according to the present invention, FIG. 2 is a front view of FIG. 1, FIG. 3 is a sectional view taken along line A—A of FIG. 2, and FIG. 4 is a sectional view taken along line B—B of FIG. 3.

The washing device for the baby bottle according to the embodiment of the present invention comprises a main body 100 having a baby bottle washing chamber 130, a door 200 installed on the top of the main body so that the door can be opened and closed, and a drive unit 120 installed in a portion excluding the baby bottle washing chamber 130 within the main body. Further, the main body 100 is formed with a supply port 139 for supplying a washing liquid to the baby bottle washing chamber, and a drain port 132 for draining the washing liquid to the exterior of the main body after the washing of the baby bottle. Although the drain port 132 is formed at a side of the main body in this embodiment, it may be formed at a bottom portion of the main body in the other embodiments.

Figure 16:
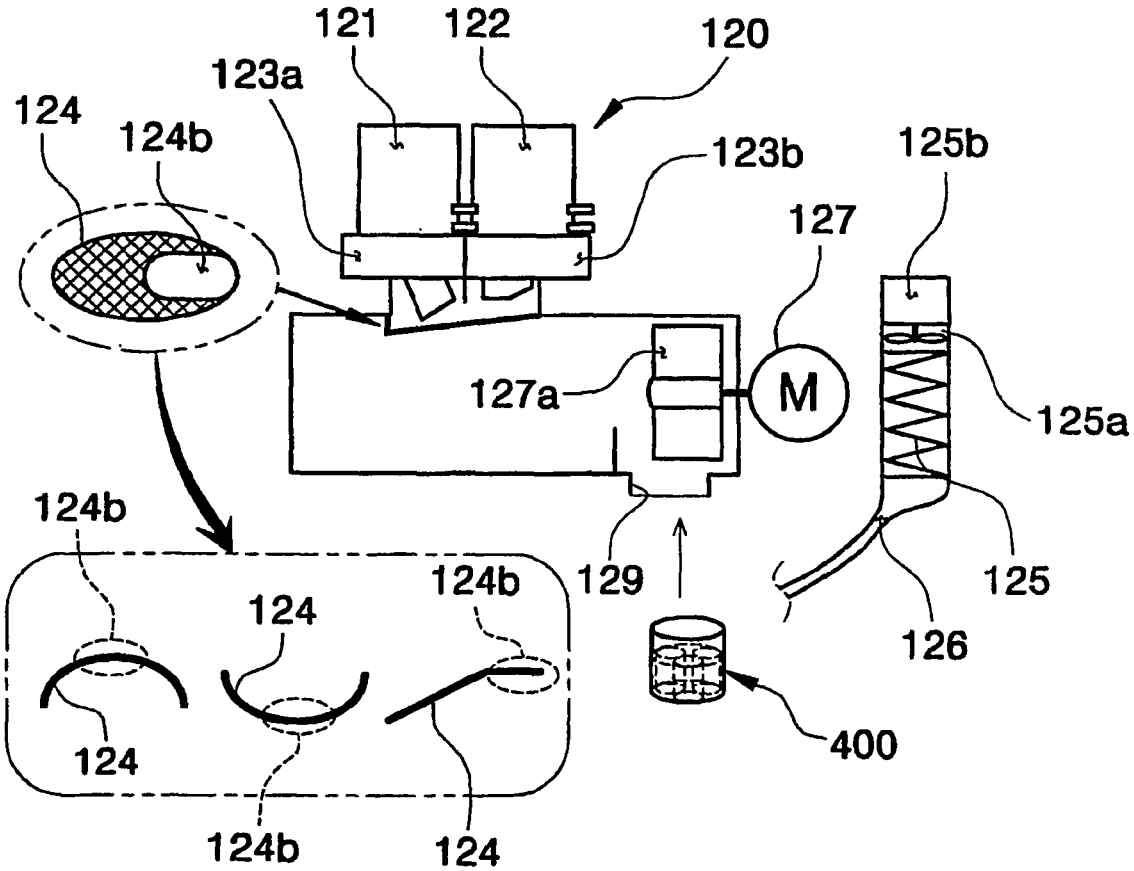
FIG. 16 is a sectional view of a drive unit for explaining a modification to that of FIG. 5.

The drive unit 120 includes a pump 129 for supplying the washing liquid to injection nozzles under high pressure, and a motor 127 for driving the pump, as shown in FIG. 16. Further, there is a washing liquid mixing chamber 128 that is connected to a suction port of the pump, supplies the pump 129 with the washing liquid and has a washing liquid mixing plate 124 therein for mixing a detergent and water supplied through a washing liquid inlet. The washing liquid mixing plate 124 takes the shape of a plate formed with a plurality of through-holes 124*a* therein. The through-holes may be formed only at a portion of the washing liquid mixing plate 124.

Moreover, a detergent storage container 122 is connected to the washing liquid mixing chamber 128 and a water tap 121 for supplying the water is also connected to the mixing chamber 128. A water supply adjustment valve 123*a* for adjusting the water supply into the mixing chamber 128 is installed between the water tap 121 and the mixing chamber 128, and a detergent adjustment valve 123*b* for adjusting the detergent supply is installed between the detergent storage container 122 and the mixing chamber 128.

An ultraviolet lamp 300 for sterilizing the baby bottle is also installed within the baby bottle washing chamber 130 of the main body 100. The ultraviolet lamp 300 is turned on for a predetermined period of time under control of a control unit 110 so as to perform a sterilizing operation. A plurality of sterilizing ultraviolet lamps 300 may be installed within the baby bottle washing chamber.

In addition, the drive unit 120 may further include a heater 125 for heating air in order to dry a washed baby bottle, and a blower 125*a* for blowing the heated air into the baby bottle washing chamber, as will be described later. The blower 125*a* is driven by a motor 125*b*. The air heated by passing through the heater 125 is supplied into the baby bottle washing chamber 130 through air tube 126 connected to the baby bottle washing chamber 130.

A front face of the main body 100 of the washing device is formed with a viewing window 101 made of material that allows view of the interior of the baby bottle washing chamber 130.

A handle portion 210 is also provided in a top surface of the door 200 for facilitating the opening and closing of the door 200.

The control unit 110 can control the operations of the motor 127, the detergent adjustment valve 123*b*, the water supply adjustment valve 123*a*, the heater 125, the blower motor 125*b* and the sterilizing ultraviolet lamp 300 individually or in a predetermined sequence for predetermined periods of time.

In the control unit 110, a control circuit thereof can be mechanically configured by using a switch, a relay, a timer and the like. However, the control of the control unit may be made electronically by using a microprocessor. Since the selection of the control unit is apparent to those skilled in the art, the more detailed description thereof will be omitted.

The control unit includes an on/off button 111 capable of interrupting the supply of electric power, a preliminary washing button 112 capable of controlling respective objects of the drive unit to be controlled, a detergent washing button 113, a water washing button 114, a hot-wind sterilization button 115, and an ultraviolet sterilization button 119. Further, a display window 116 for displaying an operating state of the washing device is included in the control unit. A set/start button 117 is disposed between the on/off button 111 and the preliminary washing button 112 to select a one-cycle circulation operation, respective operations by units, and start of such operations.

Meanwhile, a switch SW is installed between the top surface of the main body 100 of the washing device and a bottom surface of the door 200 to forcibly shut off the operating electric power when the door 200 is opened. The switch is connected to the control unit 110.

A floor of the baby bottle washing chamber 130 is constructed by an inclined surface 131 that is gradually raised from the drain port 132 toward the control unit 110 and simultaneously from the drain port 132 toward the viewing window 101 so that the washing liquid can be easily drained into a drain hose 150. The drain port 132 is threaded so that the drain hose 150 is screwed thereinto.

Further, nipple cap mount means catching portions 134 are provided on a portion of each of both side walls of the baby bottle washing chamber 130 in such a manner that a nipple cap mount means to be explained later is fitted downward from above the nipple cap mount means catching portion thereinto by a predetermined length and then seated therein so as not to rotate and that a nipple cap can be washed by a fluid injected from nozzle tube 140 installed on an upper portion of a rear surface of the washing chamber. Nipple mount means catching portions 135 are provided on a side opposite to each of the nipple cap mount means catching portions 134 in such a manner that a nipple mount means to be explained later is fitted downward from above the nipple mount means catching portions thereinto by a predetermined length and then seated therein so as not to rotate and that a nipple can be washed by a fluid injected into the nipple.

At this time, the nipple cap mount means catching portions 134 and the nipple mount means catching portions 135 are in the form of rectangular grooves to prevent the nipple cap mount means and the nipple mount means, which will be explained later, from rotating. It is also possible to cause both the mount means to be caught in the catching portions through the downward movements of the mount means at a time by providing additional members thereto.

Moreover, the nozzle tube 140 includes a first nozzle tube 141 which is connected to the pump 129 of the drive unit 120 and installed in the center of the inclined surface 131 of the baby bottle washing chamber 130; second nozzle tubes 142 which are connected to the pump 129 of the drive unit 120 and installed to be disposed at lower portions of front and rear surfaces of the baby bottle washing chamber 130; third nozzle tubes 143 which are connected to the pump 129 of the drive unit 120 and installed to be disposed at upper portions of the front and rear surfaces of the baby bottle washing chamber 130; injection nozzles for bottle bodies 144, which protrude vertically upwardly from the first nozzle tube 141 and inject the washing liquid into the bottle bodies W; injection nozzles for nipples 145, which are installed on inward surfaces of the second nozzle tubes 142 at a predetermined interval along the length thereof so as to inject the washing liquid; and injection nozzles for nipple caps 146, which are installed on inward surfaces of the third nozzle tubes 143 at a predetermined interval along the length thereof so as to inject the washing liquid.

The nozzle tube 140 can inject the washing liquid by installing the plurality of injection nozzles or by forming a plurality of holes 144*a* in the nozzle tube itself without employing any injection nozzles.

In the meantime, the nipple cap mount means 160 can be caught in and supported by the nipple cap mount means catching portions 134 provided in the baby bottle washing chamber 130 by fitting nipple cap fixing members 161 for enclosing and receiving nipple caps X around a nipple cap fixing member supporting bar 162 to be arranged at a predetermined interval thereon. The nipple cap mount means 160 presses down the bottoms of the inverted bottle bodies W to prevent play of the bottle bodies upon washing thereof.

As shown in FIGS. 3, 4, 6 and 7, each of the nipple cap fixing members 161 includes a Nuk-type nipple cap fixing ring 161*a* for securing a Nuk-type nipple cap; an Avent-type nipple cap fixing ring 161*c* disposed below the Nuk-type nipple cap fixing ring 161*a* for securing an Avent-type nipple cap through a connecting rod 161*b*; and fitting portions 161*d* to be fitted around the supporting bar, which are formed with polygonal holes at lower ends of the connecting rods 161*b* protruding downwardly beyond the Avent-type nipple cap fixing ring 161*c*.

Figure 6:
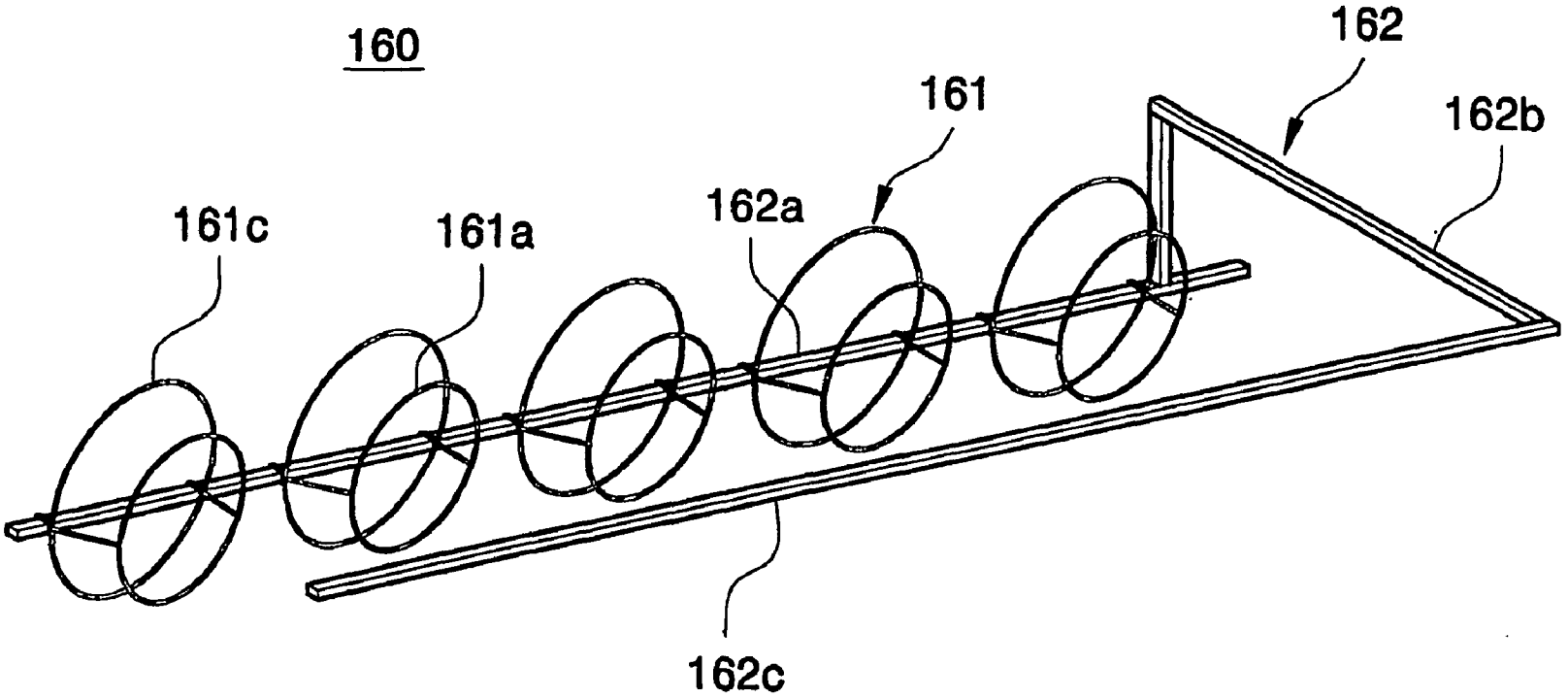
FIG. 6 is an explanatory view showing a nipple cap mount means of FIGS. 3 and 4.
Figure 7:
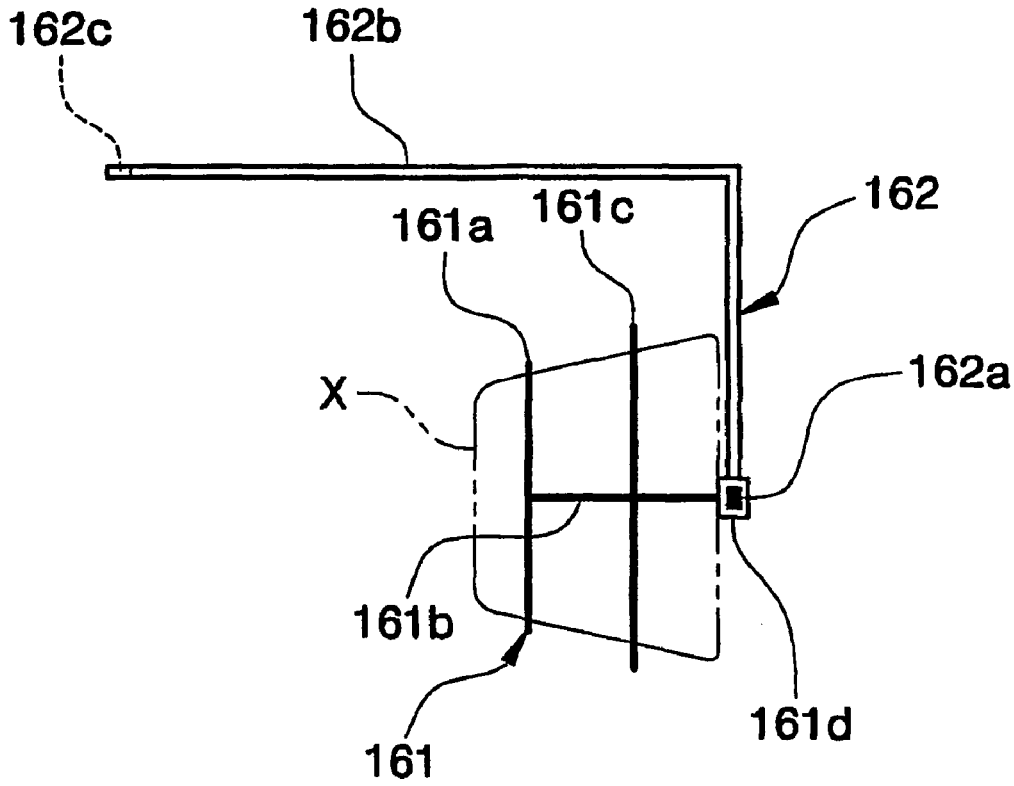
FIG. 7 is a right side view of FIG. 6.
Figure 8:
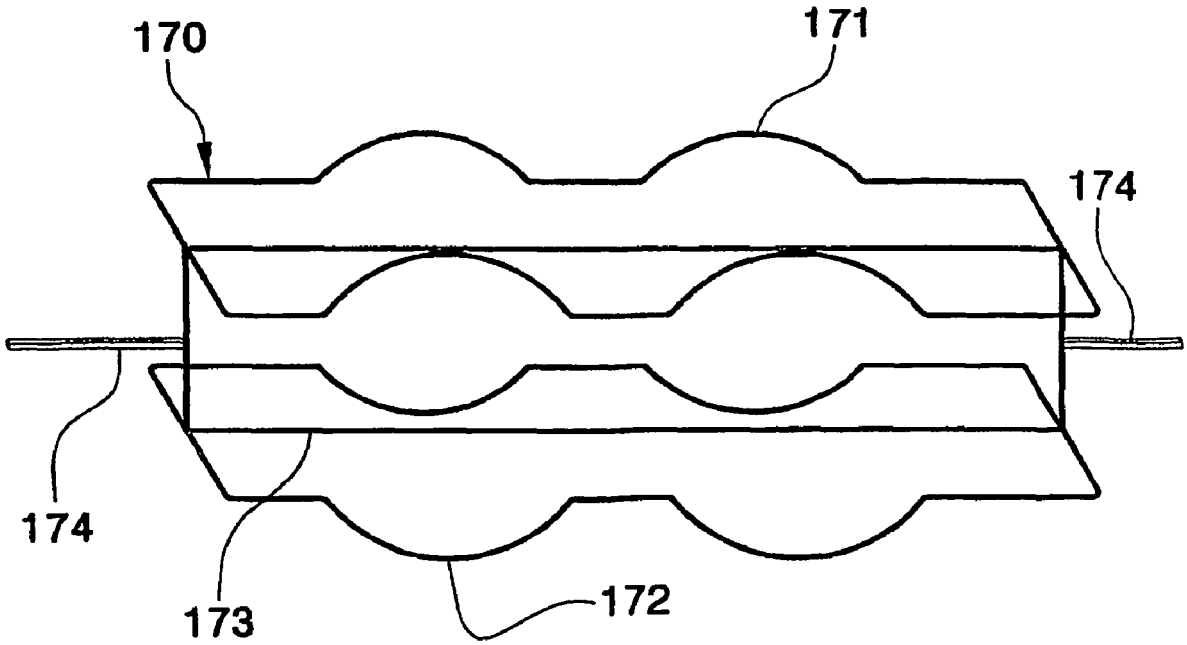
FIG. 8 is a perspective view showing a nipple mount means of FIG. 3.
Figure 9:
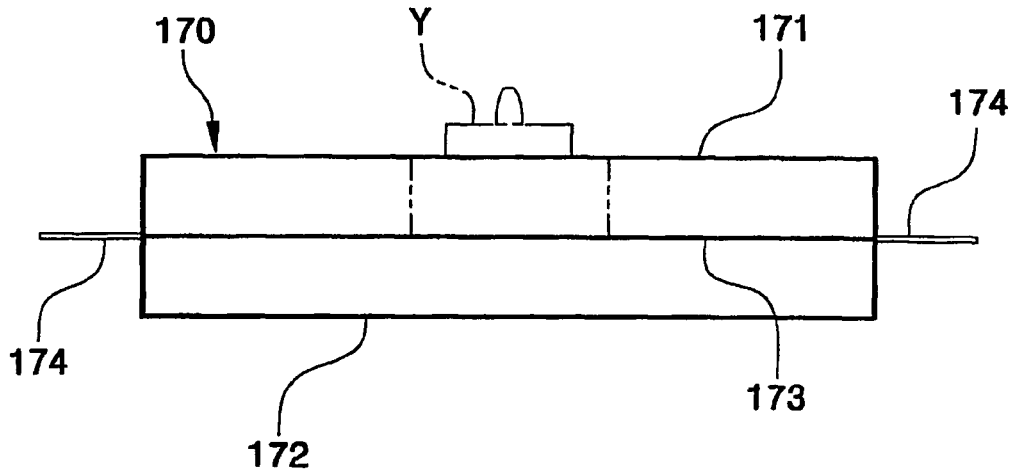
FIG. 9 is a plan view showing a state where a Nuk-type nipple is mounted on the nipple mount means of FIG. 8.
Figure 10:
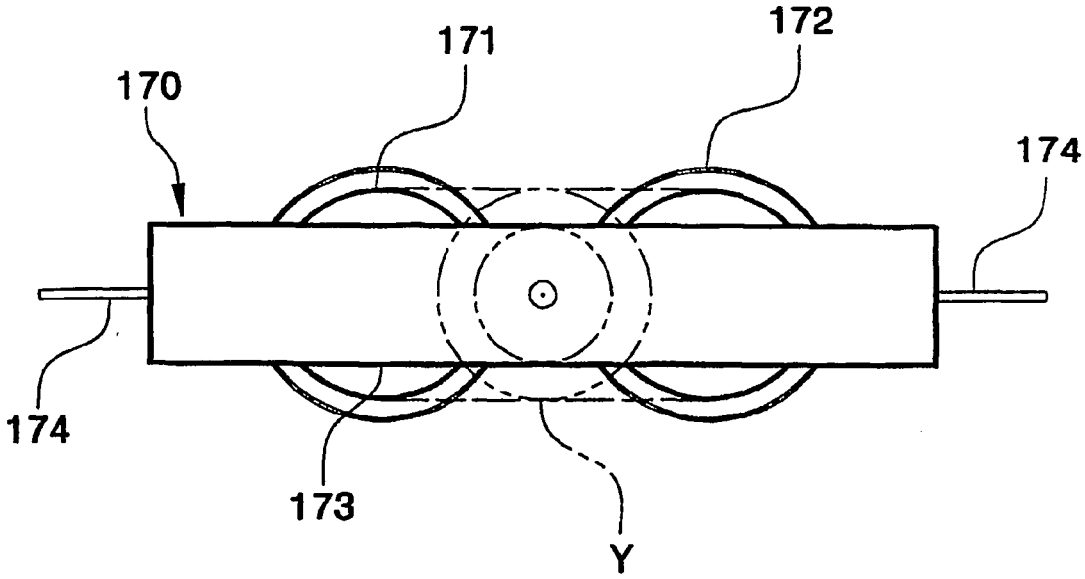
FIG. 10 is a plan view of FIG. 9.
Figure 11:
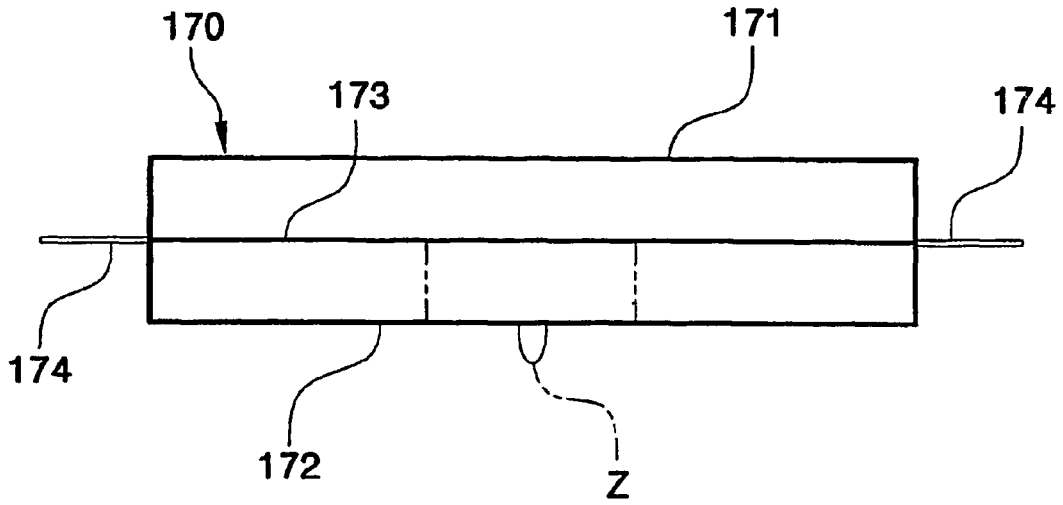
FIG. 11 is a plan view showing a state where an Avent-type nipple is mounted on the nipple mount means of FIG. 8.
Figure 12:
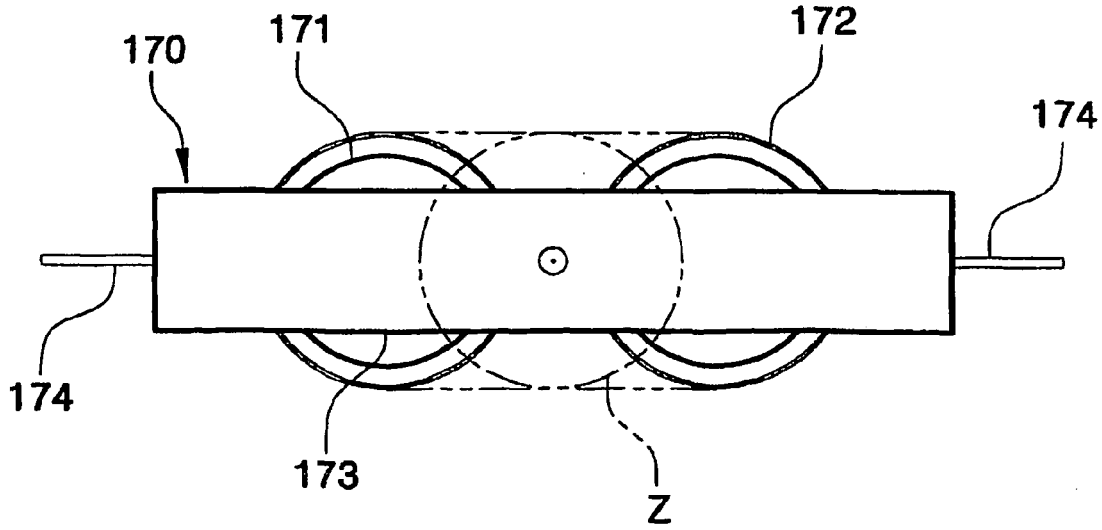
FIG. 12 is a plan view of FIG. 1.
Figure 21:
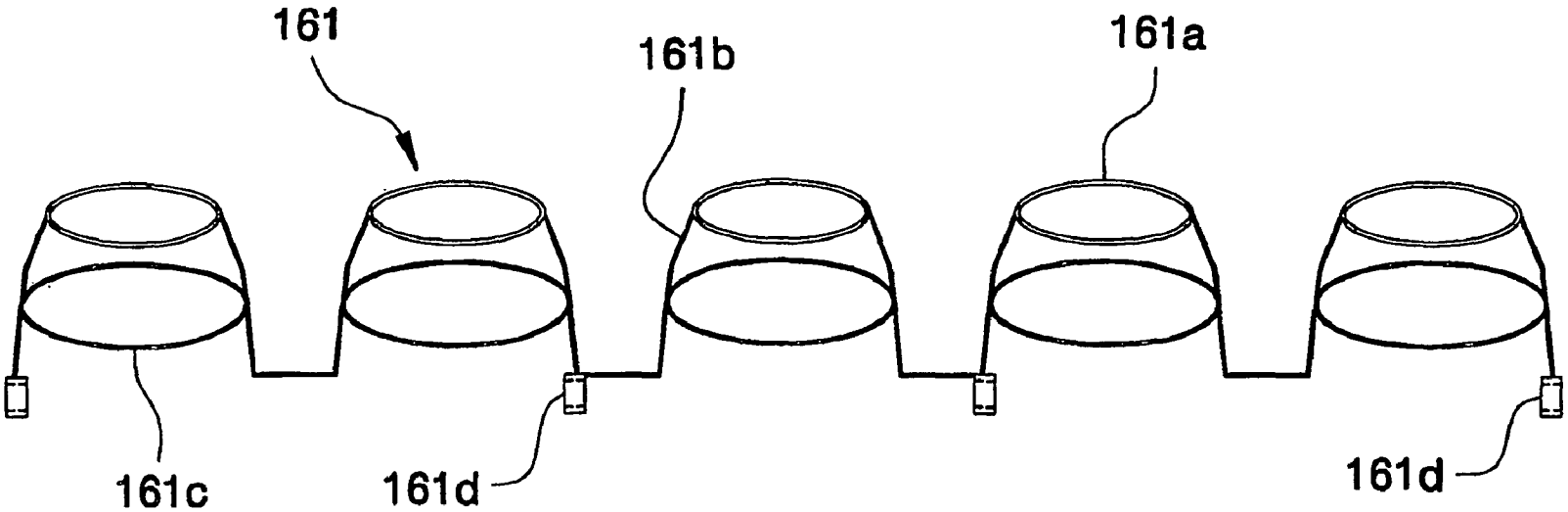
FIG. 21 is a perspective view showing a modification to the nipple cap mount means shown in FIGS. 6 and 7.

Although the plurality of the nipple cap fixing members 161 are separated from one another in the embodiment shown in FIG. 6, the nipple cap fixing member 161 in an embodiment shown in FIG. 21 is constructed such that the plurality of Nuk-type nipple cap fixing rings 161*a* and the Avent-type nipple cap fixing rings 161*c* are connected integrally with one another by the connecting rods 161*c* and that the fitting portions 161*d* to be fitted around the supporting bar are provided at a predetermined interval at a lower portion of the nipple cap fixing member.

The nipple cap fixing member supporting bar 162 includes a hanger support portion 162*a* around which the fitting portions 161*d* are fitted and which is seated in the nipple cap mount means catching portions 134; a position displacement portion 162*b* bent in the form of "]" at one end of the hanger support portion 162*a*; and a bottle body pressing portion 162*c* extending from an end of the position displacement portion 162*b*, which is opposite to the one end of the hanger support portion, in parallel with the hanger support portion 162*a* to press down the bottoms of the inverted bottle bodies W.

Further, there is provided the nipple mount means 170 which is constructed such that Nuk-type nipples Y or Avent-type nipples Z are selectively fitted thereinto and then moved laterally to be fixed thereto, and is supported by the nipple mount means catching portions 135, so that the nipples can be washed by the fluid injected from the injection nozzles for nipples 145.

At this time, as shown in FIGS. 3 and 8 to 12, the nipple mount means 170 includes Nuk-type nipple introducing portions 171 constructed to be curved in the form of an arc at a predetermined interval for guiding the insertion of the Nuk-type nipples thereinto in a case where the Nuk-type nipples Y are used; Avent-type nipple introducing portions 172 constructed to be curved in the form of an arc at a predetermined interval and disposed to be spaced apart by a predetermined distance from the respective Nuk-type nipple introducing portions 171 for guiding the insertion of the Avent-type nipples thereinto in a case where the Avent-type nipples Z are used; a portion for supporting the bottoms of nipples 173 disposed between the Nuk-type nipple introducing portions 171 and the Avent-type nipple introducing portions 172 so as to support the bottoms of the Nuk-type or Avent-type nipples selectively inserted thereinto; and anti-rotation support bars 174 which integrally connect the Nuke-type nipple introducing portions 171, the Avent-type nipple introducing portions 172 and the supporting portion 173 with one another, extend longitudinally from both ends of the supporting portion 173 and are fitted into the nipple mount means catching portions 135 to prevent the nipple mount means from rotating.

Bottle body supporting members 147 are also installed at upper portions of the injection nozzles for bottle bodies 144 to safely support the bottle bodies W of the baby bottles.

Figure 13:
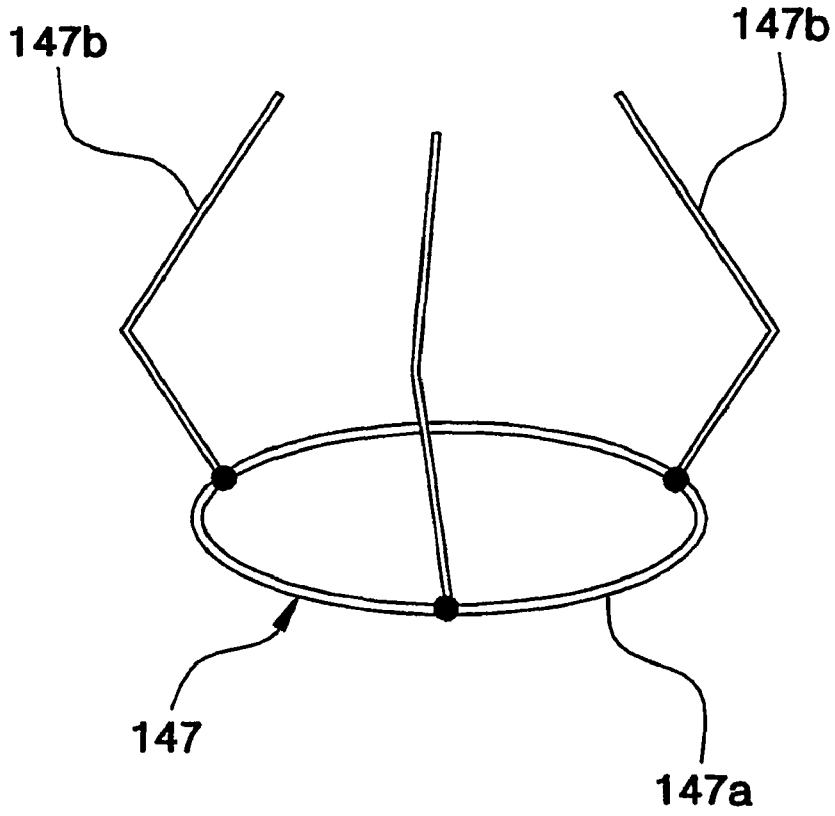
FIG. 13 is a perspective view showing a bottle body support member of FIGS. 3 and 4.

As shown in FIG. 13, each of the bottle body supporting members 147 includes a fixing ring portion 147*a* fitted around and fixed to the upper portion of the injection nozzle for bottle body 144; and bottle body supporting portions 147*b* secured to the fixing ring portion 147*a* at a predetermined interval and having bent portions for supporting an inner surface of the bottle body W. Although the bottle body supporting portions 147*b* are provided to extend only upwardly from the fixing ring portion in FIG. 13, they may also be provided to extend downwardly in a symmetric manner. Furthermore, the bent portions of the bottle body supporting portions 147*b* should be sufficiently rounded to prevent the inner surface of the bottle body from being damaged. Moreover, the bottle body supporting portions are made of materials having sufficient elasticity so that they can be used regardless of the circumferential size of the bottle body and the bottle body can be easily fitted around and removed from the supporting portions.

The washing device for the baby bottle is first installed before water supply and connected to a power supply. Then, in order to wash baby bottles collectively, the door 200 is opened and respective bottle bodies W of the baby bottles to be washed are fitted around and seated on the respective injection nozzles for bottle bodies 144. Thus, the bottle bodies W are supported by the bottle body supporting members 147. Next, the nipple caps X are accommodated in the nipple cap mount means 160 which in turn is installed by fitting the hanger support portion 162*a* of the nipple cap fixing member supporting bar 162 into the nipple cap mount means catching portions 134 as shown in FIG. 3. Then, nipples used among the Nuke-type nipples Y or the Avent-type nipples Z are fitted into the nipple mount means 170 which in turn is in a washing position by the anti-rotation supporting support bar 174 is inserted into the nipple mount means catching portions 135 with the interiors of the fitted nipples directed toward the respective injection nozzles for nipples 145. Subsequently, the door 200 is closed and the set/start button 117 of the control unit 110 is manipulated to select the detergent washing or water washing. If it is determined that the washing process is insufficient after the selected operation is completed, additional washing can be made by separately manipulating respective buttons.

The valves 123*a*, 123*b* and the motor 127 of the drive unit 120 are operated in response to signals from the control unit 110 in accordance with the washing process. In the preliminary washing, the water supply adjustment valve 123*a* is opened to supply the water and an impeller 127 of the pump is rotated, so that the water is injected into the interiors of the bottle bodies W from the chamber 128 and the pump 129 through the first nozzle tube 141 and the injection nozzles for bottle bodies 144 and the nozzles or holes 144*a* thereof. The water is injected toward the nipples Y, Z through the second nozzle tube and the injection nozzles for nipples 145. The water is also injected toward the nipple caps X through the third nozzle tube 143 and the injection nozzles for nipple caps 146. The preliminary washing is performed in such a manner.

Next, in the detergent washing, both the water supply adjustment valve 123*a* and the detergent adjustment valve 123*b* are opened to simultaneously supply the water and the detergent which are mixed in the washing liquid mixing plate 124. The washing liquid with the mixed water and detergent is injected from the injection nozzles for bottle bodies 144, the injection nozzles for nipples 145 and the injection nozzles for nipple caps 146 in a manner similar to that of the preliminary washing.

When the detergent washing is completed, only the water is injected from the injection nozzles for bottle bodies 144, the injection nozzles for nipples 145 and the injection nozzles for nipple caps 146 toward the bottle bodies W, the nipples Y, Z and the nipple caps X in the same manner as the preliminary washing.

Of course, the water and the washing liquid used for the preliminary washing, the detergent washing and the water washing are drained through the drain hose 150.

Next, when the water washing is completed, air is heated by the heater 125 and the heated air is caused to pass through the air tube 126 by the blower 125*a* and to dry the components of the baby bottles.

Then, during or after the drying of the components of the baby bottles, the ultraviolet lamp 300 is turned on to sterilize the bottle bodies W, the nipples Y, Z and the nipple caps X.

When the whole washing process is completed, a user grips the handle portion 210 of the door 200 and opens the door. The nipple cap mount means 160 is removed from the baby bottle washing chamber 130 and the nipple cap fixing member supporting bar 162 is disconnected from the fitting portions 161*d*. Thus, the washed nipple caps X are obtained.

Further, as to the bottle bodies W, the washed bottle bodies W are obtained by lifting up the bottle bodies W which have been subjected to the washing process.

The nipple mount means 170 is taken out from the baby bottle washing chamber 130 by lifting up the nipple mount means 170 along the nipple mount means catching portions 135 of the baby bottle washing chamber 130. Then, the washed nipples Y, Z are moved to the Nuk-type nipple introducing portions 171 and the Avent-type nipple introducing portions 172 and then taken out therefrom.

The nipple mount means 170 may be constructed to be exclusively used for either one-type portions of the Nuk-type nipple introducing portions 171 or the Avent-type nipple introducing portions 172.

Figure 14:
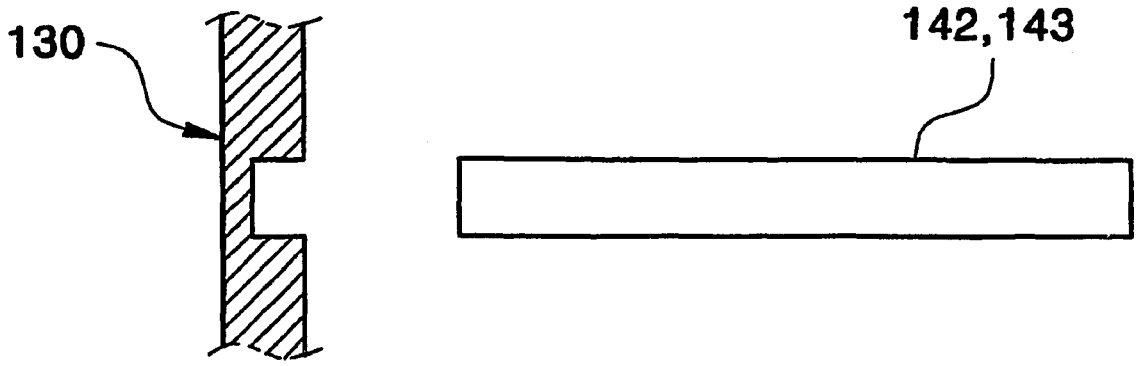
FIG. 14 is an explanatory view showing a state where grooves are formed in a baby bottle washing chamber and nozzle tubes are to be installed therein.
Figure 15:
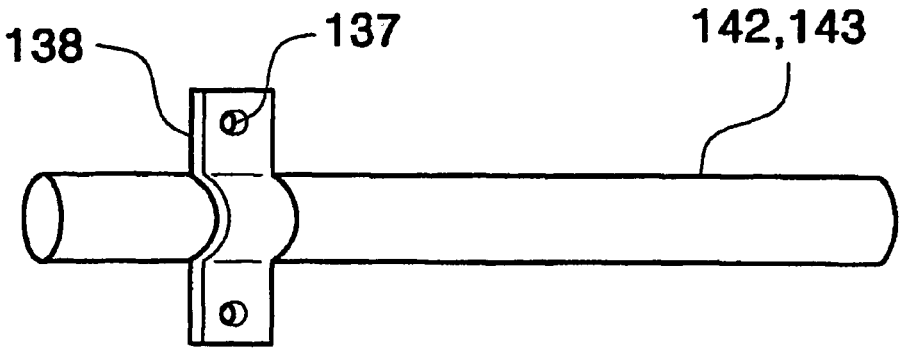
FIG. 15 is an explanatory view showing a state where the nozzle tubes are installed in the baby bottle washing chamber of the washing device of the present invention by using fastening members.

Meanwhile, as to a method of installing the second and third nozzle tubes 142, 143 of the nozzle tube 140 in the baby bottle washing chamber 130 of the main body 100 of the washing device, fixing grooves 136 are formed in the baby bottle washing chamber 130 as shown in FIG. 14 and the second and third nozzle tubes 142, 143 are fitted into the grooves. Alternatively, the second and third nozzle tubes 142, 143 may be fixed by means of separate fixing members 138 to be secured on the baby bottle washing chamber 130 with fastening members 137 such as screws, as shown in FIG. 15.

It is also preferred that the interior of the baby bottle washing chamber 130 be made of rustproof materials such as stainless steel.

The washing liquid mixing plate 124 has a detergent loading surface 124*b* that is a solid portion of the mixing plate so that the detergent is mixed with the water when it is supplied to the plate. The washing liquid mixing plate 124 can be curved or bent at a predetermined angle, as shown in FIG. 16.

A condenser may be added to the motor 127 or the control unit 110 in order to control a phase angle at initial driving or activation thereof. Alternatively, a pump and a motor for a dishwasher may be employed according to the using circumstances.

Moreover, a branch connector 400 into which the first, second and third nozzle tubes 141, 142 and 143 of the nozzle tube 140 are fitted may be installed at a discharge port of the pump 129 to adjust the supply and injection pressure of the water and the detergent that are supplied to the first, second and third nozzle tubes 141, 142 and 143.

Figure 17:
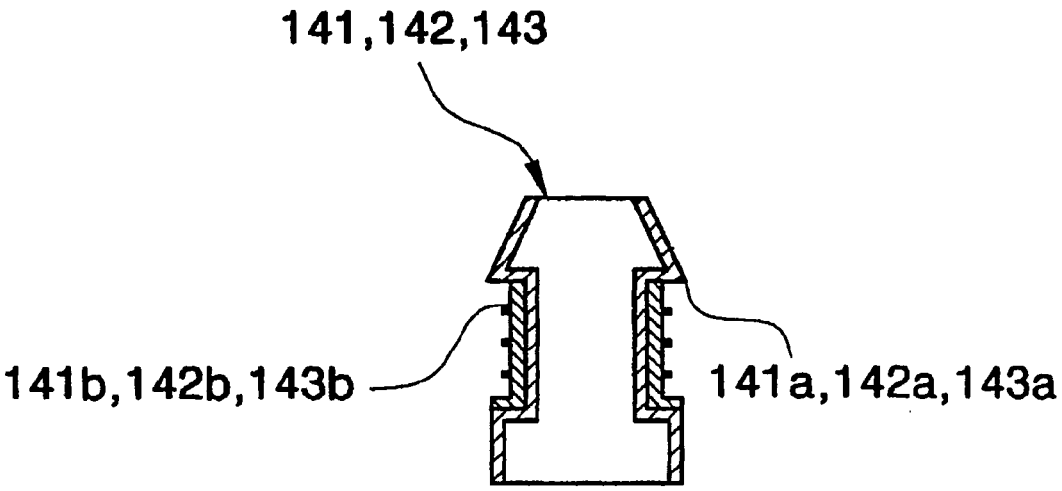
FIG. 17 is a detailed explanatory view showing nozzle tube of FIG. 16.

As shown in FIG. 17, respective ends of the nozzle tubes of the nozzle tube 140 are formed with hooks 141*a*, 142*a* and 143*a* to facilitate the coupling with the pump 129 shown in FIG. 16. Rubber packing 141*b*, 142*b* and 143*b* with two or three peaks formed around an outer periphery thereof is also fitted to be positioned in the rear of the hooks, thereby preventing leakage of the water and the detergent and facilitating the coupling.

Figure 18:
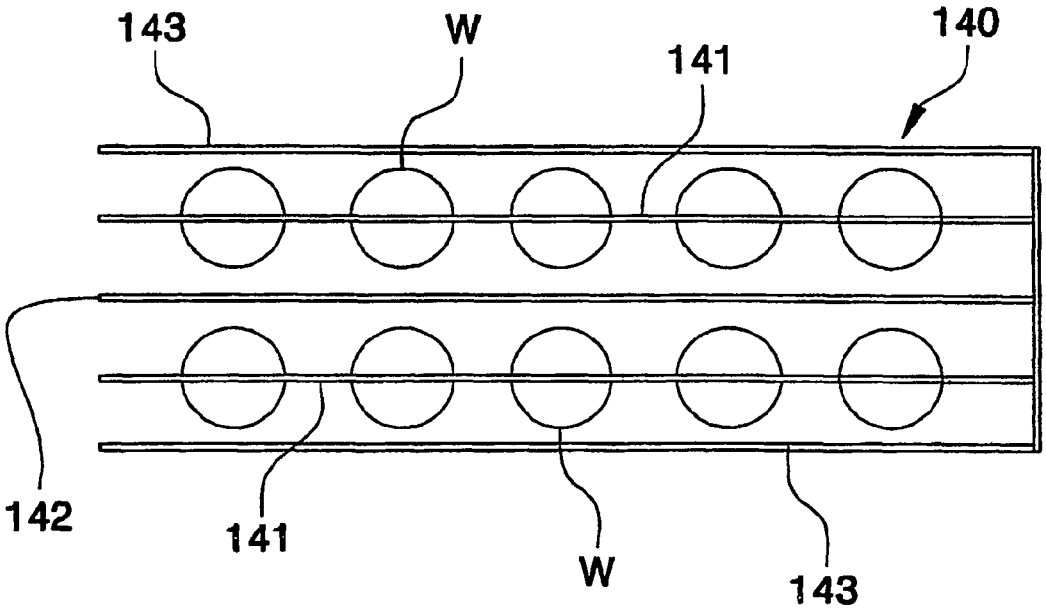
FIG. 18 is a plan view of nozzle tube for explaining a modification to a nozzle tube of FIG. 3.

In a case where more bottle bodies W should be mounted in the baby bottle washing chamber, the first nozzle tubes 141 around which the bottle bodies are fitted are arranged in two rows as shown in FIG. 18. Additional nozzle tubes may be installed in such a manner that the second nozzle tubes 142 are installed to inject the water and the detergent for washing outer surfaces of the bottle bodies W, which are arranged in the two rows by being fitted around the first nozzle tubes 141, and the opposite nipples disposed at a lower portion in the baby bottle washing chamber, and that the third nozzle tubes 143 are installed to inject the water and the detergent for washing the outer surfaces of the bottle bodies W. which are fitted around the first nozzle tubes 141, and the nipple caps disposed at an upper portion in the baby bottle washing chamber.

Figure 19:
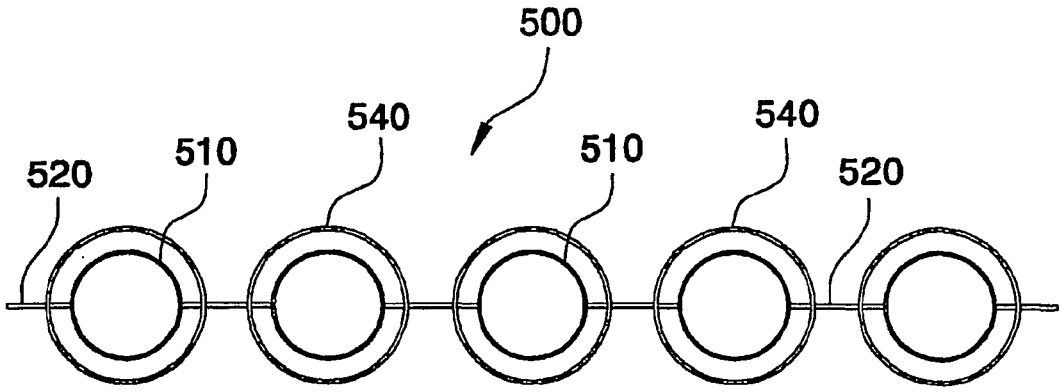
FIG. 19 is a plan view showing a bottle body fixing stand of the washing device according to the present invention.
Figure 20:
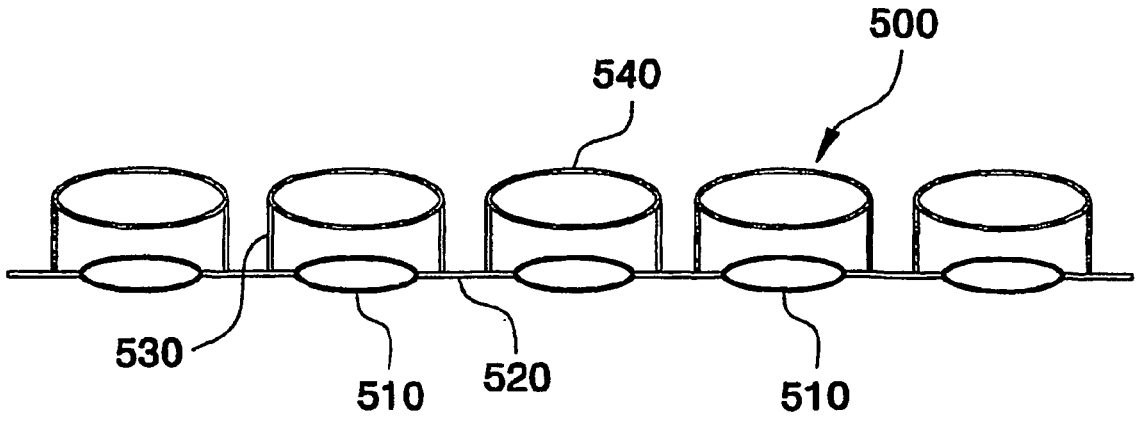
FIG. 20 is a perspective view of the bottle body fixing stand shown in FIG. 19.

Meanwhile, a bottle body mount member 500 shown in FIGS. 19 and 20 may be installed on the first nozzle tubes 141 within the baby bottle washing chamber 130 so that the mouths of the bottle bodies W can be fitted into and supported by the bottle body mount member. In the bottle body mount member, first insertion rings 510 into which the mouths of the bottle bodies W are fitted are continuously connected to one another through connection rods 520. Second insertion rings 540 are also provided to be connected to the connection rods 520 through vertical connection rods 530 vertically protruding from the connection rods 520, so that bottle bodies having larger mouths can be fitted into and supported by the second insertion rings. Here, only one of the first and second insertion rings 510, 540 may be constructed to be exclusively used therefor. Moreover, in the nipple cap mount means shown in FIG. 21, only one of the Avent-type nipple cap fixing rings 161*c* and the Nuk-type nipple cap fixing rings 161*a* may be constructed to be exclusively used therefor.

Figure 22:
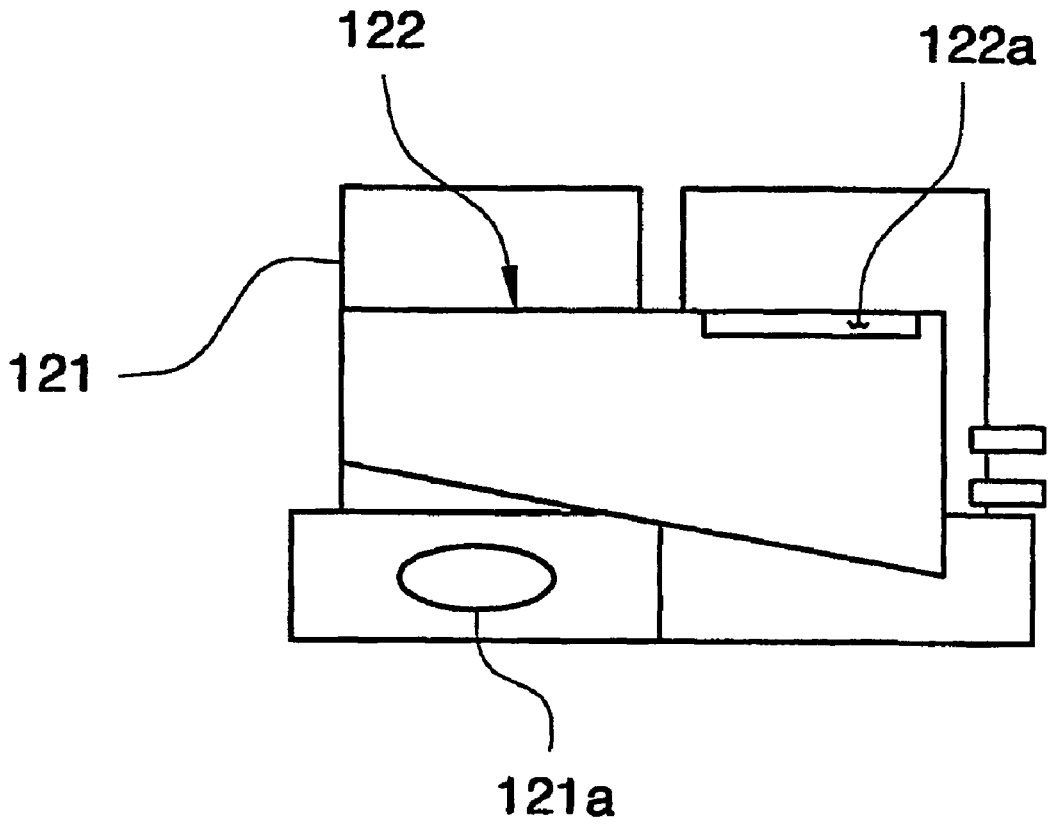
FIG. 22 is a detailed explanatory view showing a detergent supply portion of FIG. 16.

Further, it is preferred that the detergent storage container 122 be constructed such that a detergent cover 122*a* installed at the top thereof can be slidably opened and closed as shown in FIG. 22.

Figure 23:
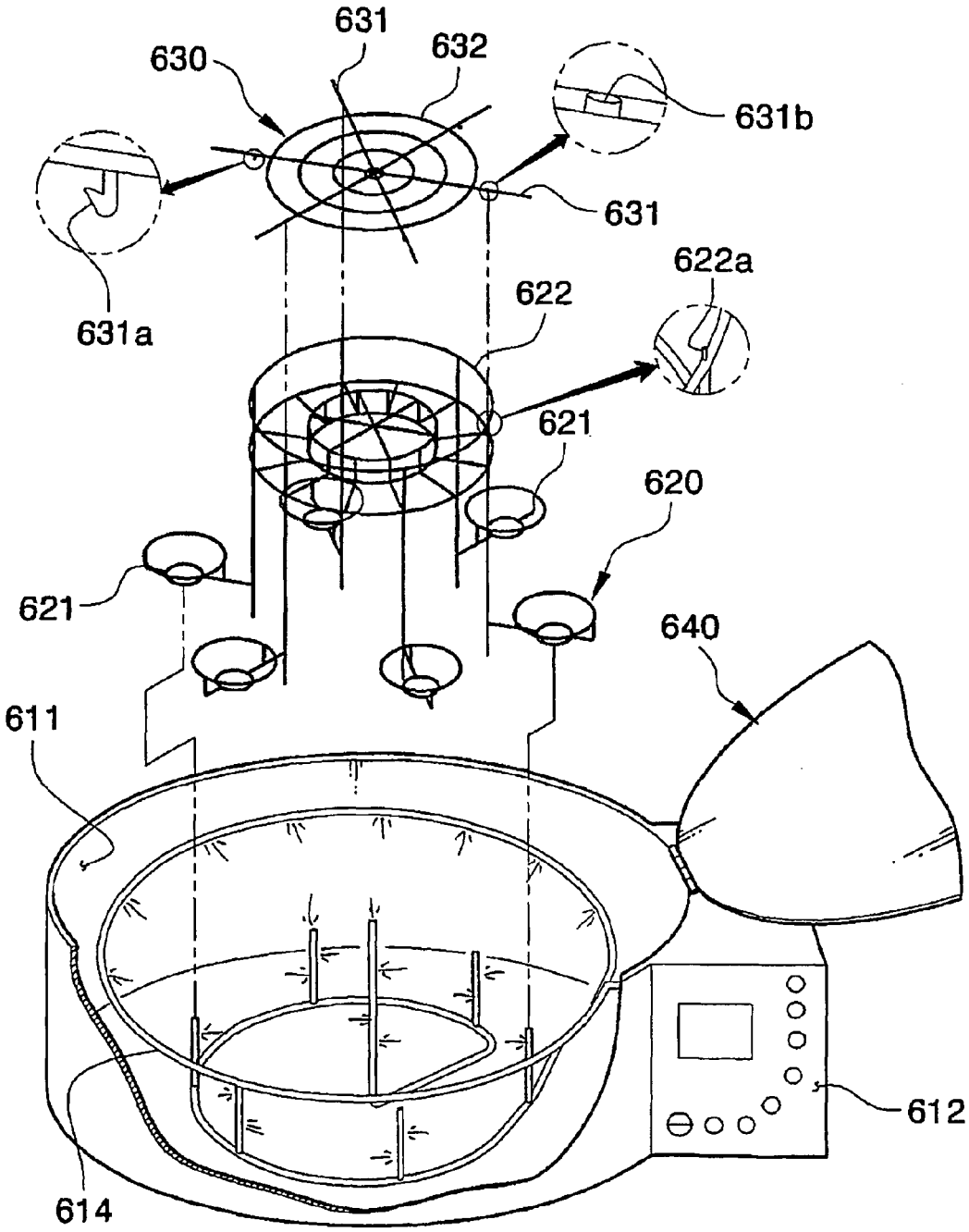
FIG. 23 is an exploded perspective view showing another embodiment of the washing device for the baby bottle according to the present invention.
Figure 24:
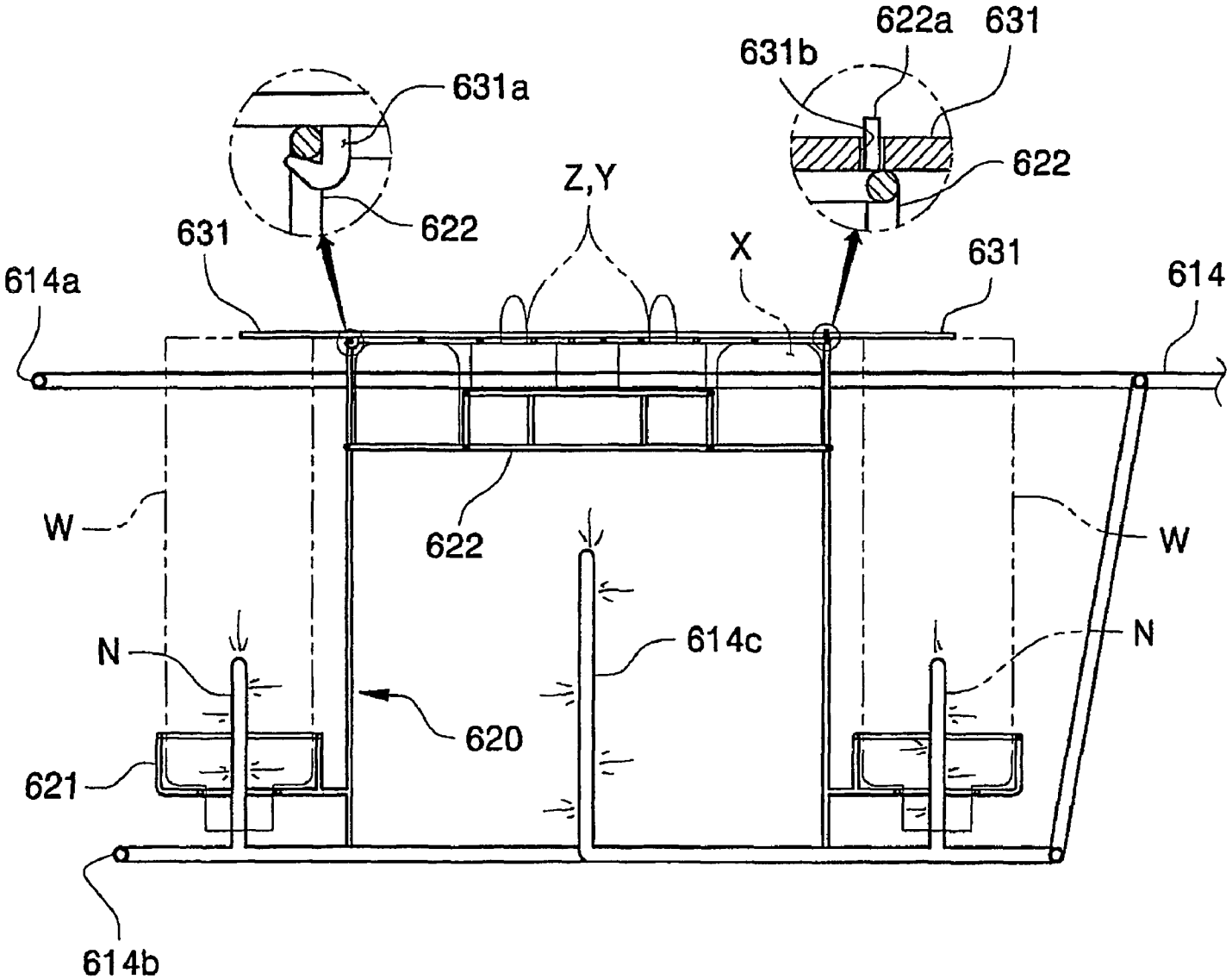
FIG. 24 is a sectional view showing an essential portion of FIG. 23.

In the meantime, FIGS. 23 and 24 are an exploded perspective view showing a second embodiment of the washing device for the baby bottle according to the present invention, and a sectional view showing an essential portion thereof, respectively.

The second embodiment is characterized in that the nozzle tube is constructed by integrally-formed unitary nozzle tube 614 from which the washing liquid is injected toward the interiors and upper and lower inner/outer peripheral surfaces of the bottle bodies.

The nozzle tube 614 includes a first circular injection section (second nozzle) 614*a* which is connected to the pump 129 and performs injection toward the upper outer peripheral surfaces of the bottle bodies; a second injection section 614*b* which helically extends from a trailing end of the first injection section to a floor of a baby bottle washing chamber 611 constituting the interior of a main body 610 of a washing device for a baby bottle 600, then continuously extends to form a circle on the floor and includes internal nozzles (first nozzle) N protruding upwardly from the second injection section at a predetermined interval so that the mouths of the bottle bodies can be fitted around the internal nozzles; and a third injection section 614*c* which extends vertically from a trailing end of the second injection section in the center of the floor to perform injection toward the bottle bodies, the nipples and the nipple caps.

Reference numerals 612 and 640 that have not yet been explained designate a control unit and a cover, respectively.

The second embodiment is also characterized in that a bottle body seating means 620 is installed within the baby bottle washing chamber 611. The bottle body seating means 620 includes a plurality of bottle body mount portions (bottle body supports) 621 in which the mouths of the bottle bodies can be seated in accordance with the types of the bottle bodies; and a nipple/nipple cap mount portion (auxiliary support) 622 which is connected to the bottle body mount portions (bottle body supports) 621 and has a central portion raised upwardly by a predetermined height and upwardly protruding pins 622*a* at predetermined positions on an upper face of the nipple/nipple cap mount portion and in which the plurality of nipples are seated in the central portion and the nipple caps are seated in a peripheral portion around the central portion. That is, the bottle body mount portions (bottle body supports) 621 support the bottle bodies in such a state where the mouths of the plurality of the bottle bodies are spaced apart by a predetermined distance from and directed to the floor of the baby bottle washing chamber 611. The nipple/nipple cap mount portion (auxiliary support) 622 has a plane for allowing the plurality of nipples and nipple caps to be aligned in one direction and accommodated therein. Furthermore, the second injection section 614*b* including the internal nozzles (first nozzle) N protruding upwardly from the second injection section at the predetermined interval so that the mouths of the bottle bodies can be fitted around the internal nozzles is installed on the floor of the main body to wash the interiors of the plurality of bottle bodies.

The second embodiment further comprises a bottle body supporting means (bottle body escape preventer) 630 which includes bottle body supporting portions (pressing bars) 631 extending to support the bottoms of the inverted bottle bodies and formed with hooks 631*a* and holes 631*b* at predetermined positions, and reinforcing portions (wire frame plate) 632 for supporting and reinforcing the bottle body supporting means 631.

Therefore, since the plurality of bottle bodies, nipple caps and nipples are supported by the bottle body seating means 620 and the bottle body supporting means 630 inside the nozzle tube 614 integrally installed within the baby bottle washing chamber 611, they are not caused to be moved or to escape from their locations upon washing thereof.

Figure 25:
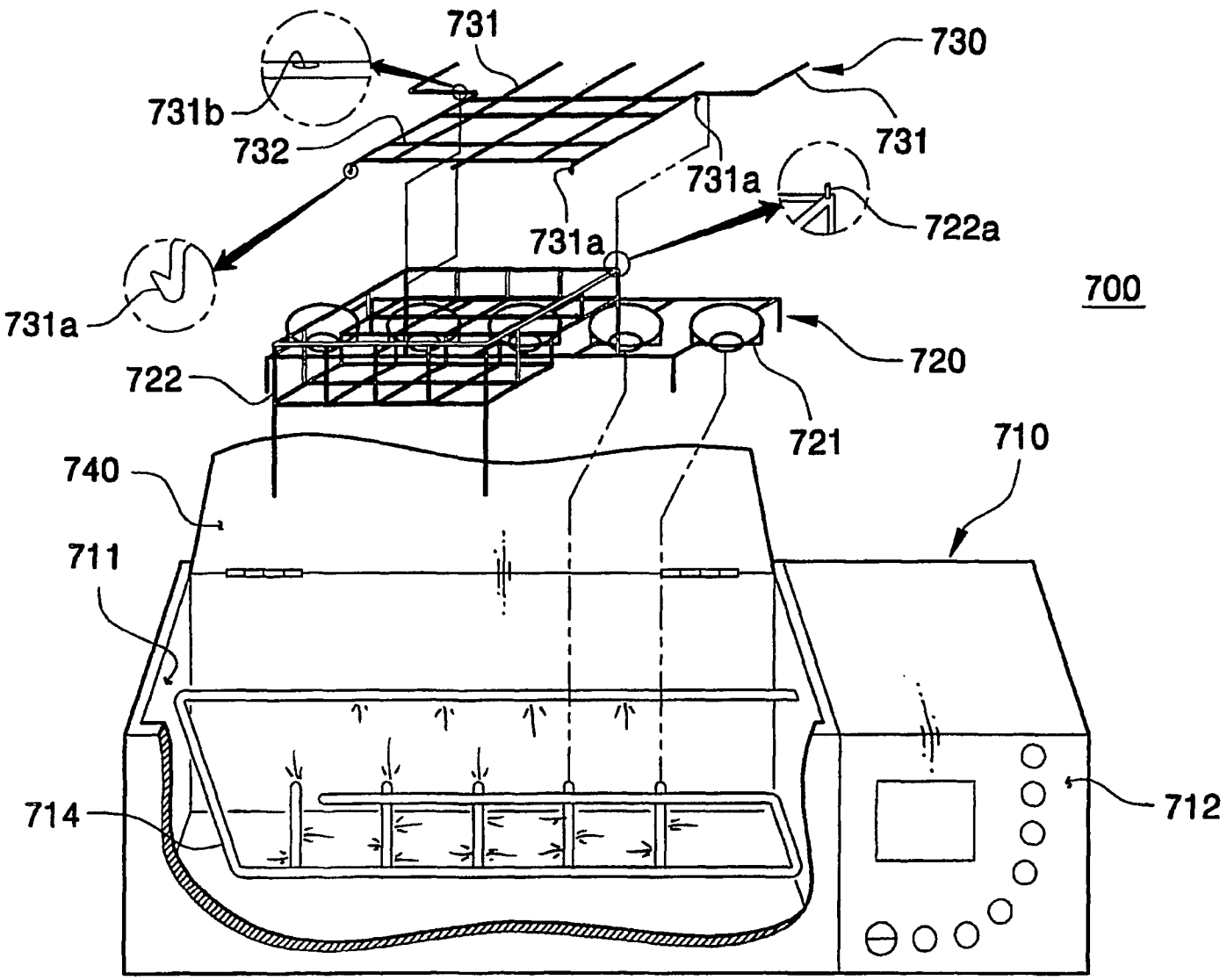
FIG. 25 is an exploded perspective view showing a further embodiment of the washing device for the baby bottle according to the present invention.
Figure 26:
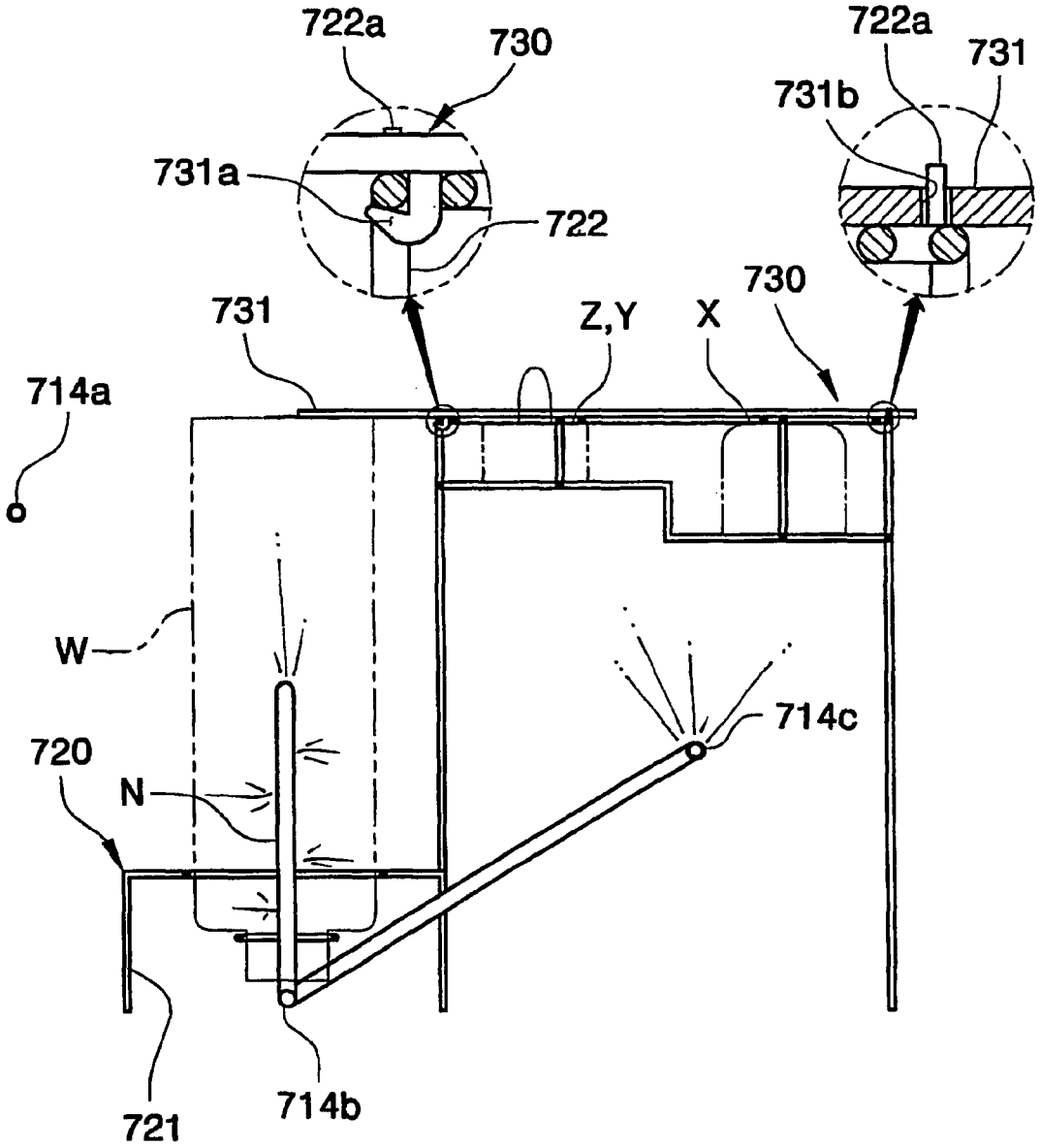
FIG. 26 is a sectional view showing an essential portion of FIG. 25.
Figure 27:
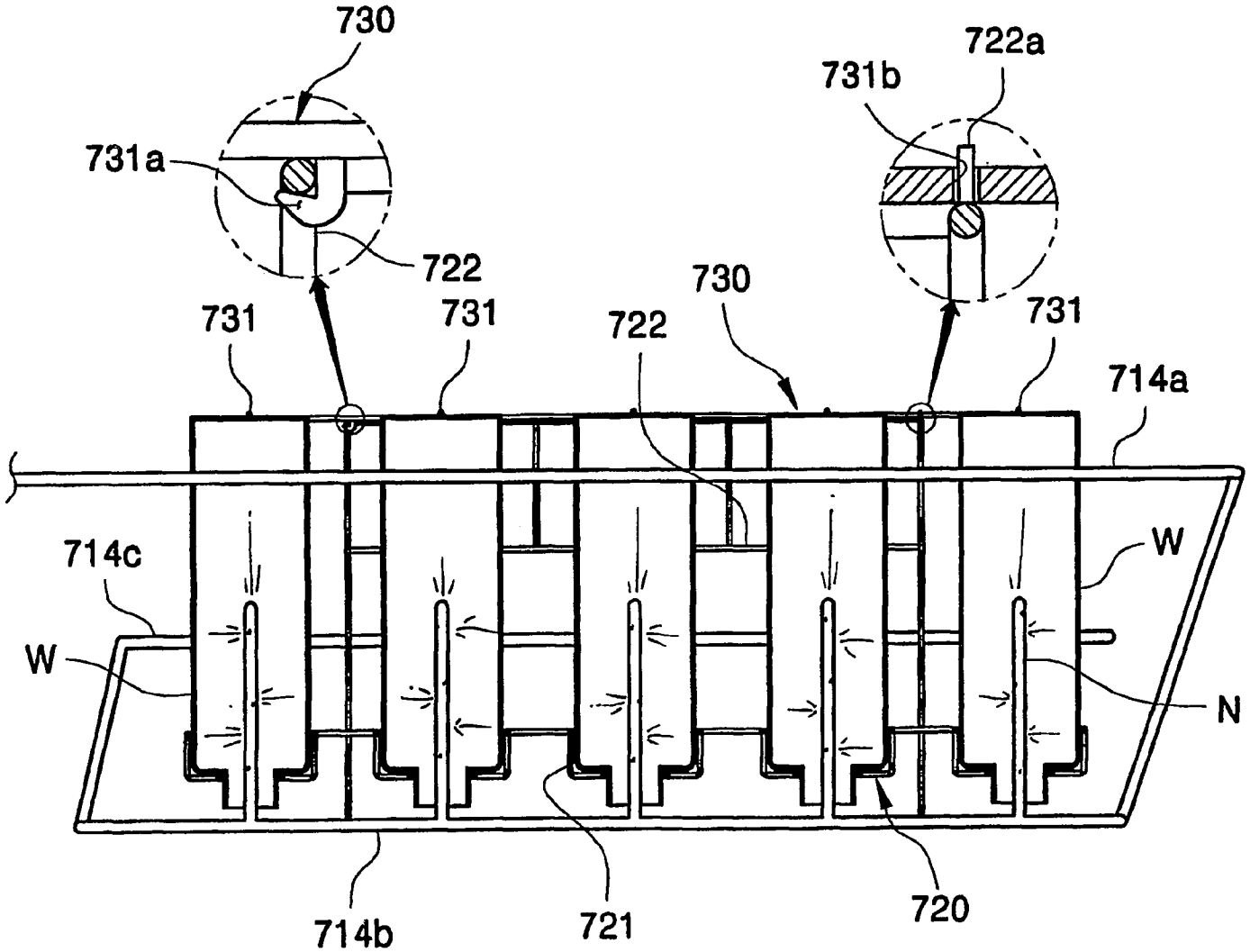
FIG. 27 is a sectional view of FIG. 26.

In the meantime, FIG. 25 is an exploded perspective view showing a third embodiment of the washing device for the baby bottle according to the present invention, FIG. 26 is a sectional view showing an essential portion of FIG. 25, and FIG. 27 is a sectional view of FIG. 26.

The third embodiment is characterized in that the nozzle tube is constructed by integrally-formed unitary nozzle tube 714 which is connected to the pump 129 and from which the washing liquid is injected toward the interiors and upper and lower inner/outer peripheral surfaces of the bottle bodies, in the same manner as the second embodiment.

The nozzle tube 714 includes a first injection section (second nozzle) 714*a* which extends straightly and performs injection toward the upper outer peripheral surfaces of the bottle bodies; a second injection section 714*b* which extends from a trailing end of the first injection section to a floor of a baby bottle washing chamber 711, then continuously extends straightly on the floor and includes internal nozzles (first nozzle) N protruding upwardly from the second injection section at a predetermined interval so that the mouths of the bottle bodies can be fitted around the internal nozzles; and a third injection section 714*c* which extends from a trailing end of the second injection section in parallel with the second injection section to perform injection toward the lower outer peripheral surfaces of the bottle bodies and the nipples and the nipple caps placed on a nipple/nipple cap seating portion to be explained later.

The third embodiment is also characterized in that a bottle body seating means 720 is installed within the baby bottle washing chamber 711. The bottle body seating means 720 is constructed integrally by a plurality of bottle body mount portions (bottle body supports) 721 disposed at a predetermined interval so that the mouths of the bottle bodies can be seated therein in accordance with the types of the bottle bodies; and a nipple/nipple cap mount portion (auxiliary support) 722 which extends from one side of the bottle body mount portions 721 and has an inner portion raised upwardly by a predetermined height and upwardly protruding protrusions 722*a* at predetermined positions and in which the plurality of nipples are seated in a row in the raised inner portion and the nipple caps are seated in a portion close to an inner wall of the bottle body washing chamber 711.

On the bottle body seating means 720, there is provided a bottle body supporting means (bottle body escape preventer) 730 which includes bottle body supporting portions (pressing bars) 731 extending to support the bottoms of the inverted bottle bodies and formed with hooks 731*a* and holes 731*b* into which the protrusions 722*a* are inserted at predetermined positions, and reinforcing portions (wire frame plate) 732 for supporting and reinforcing the bottle body supporting means 731 at a predetermined interval.

Reference numerals 700, 710, 712 and 740 that have not yet been explained designate a washing device for a baby bottle, a main body of the washing device, a control unit and a cover, respectively.

Therefore, since the plurality of bottle bodies, nipple caps and nipples are supported by the bottle body seating means 720 and the bottle body supporting means 730 inside the nozzle tube 714 integrally installed within the baby bottle washing chamber 711, they are not caused to be moved or to escape from their locations upon washing thereof.

Figure 28:
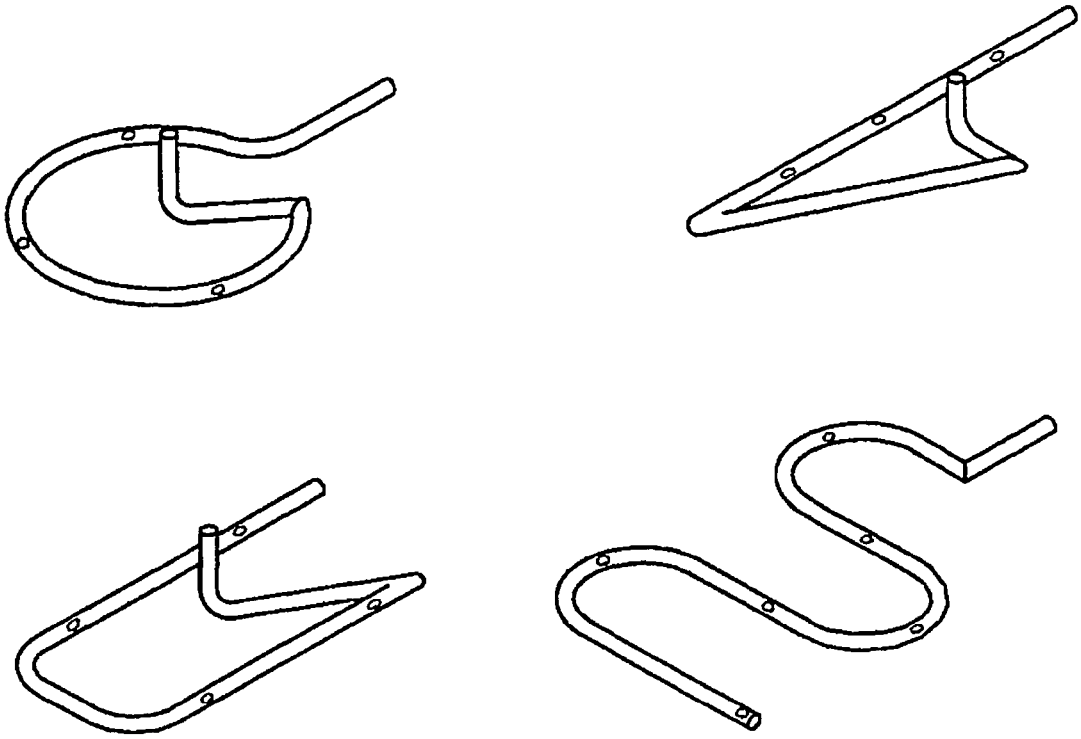
FIG. 28 shows the other embodiments of the nozzle tube installed in the baby bottle washing chamber.

FIG. 28 shows the other embodiments of the nozzle tube installed in the baby bottle washing chamber.

The nozzle tube of each of the embodiments shown in FIG. 28 has an integrally formed structure in which nozzles (holes) (second injection section; first nozzle) are provided at portions of the nozzle tube corresponding to locations where the bottle bodies are placed and nozzles (holes) (first and third injection sections; second nozzle) are formed at portions of the nozzle tube corresponding to locations where the nipple caps and the nipples are placed.

Figure 29:
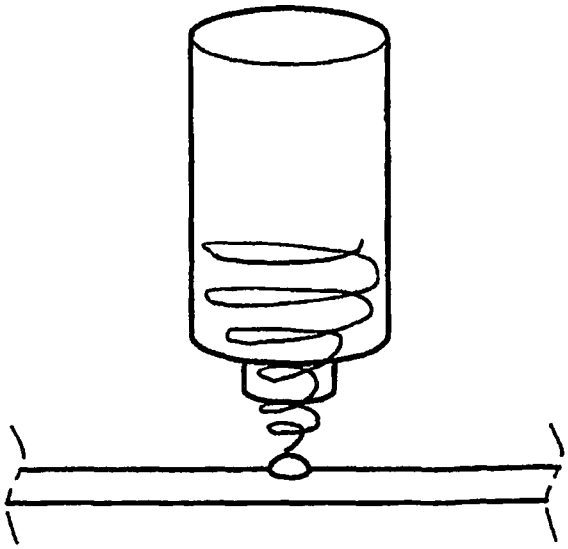
FIG. 29 is a schematic view showing an injection configuration of a rotary nozzle.

FIG. 29 is a schematic view showing an injection configuration of a rotary nozzle.

As shown in FIG. 29, in a case where the rotary nozzle is used, the washing liquid is flaringly injected in the form of a swirl to easily wash the interior of each of the bottle bodies.

Figure 30:
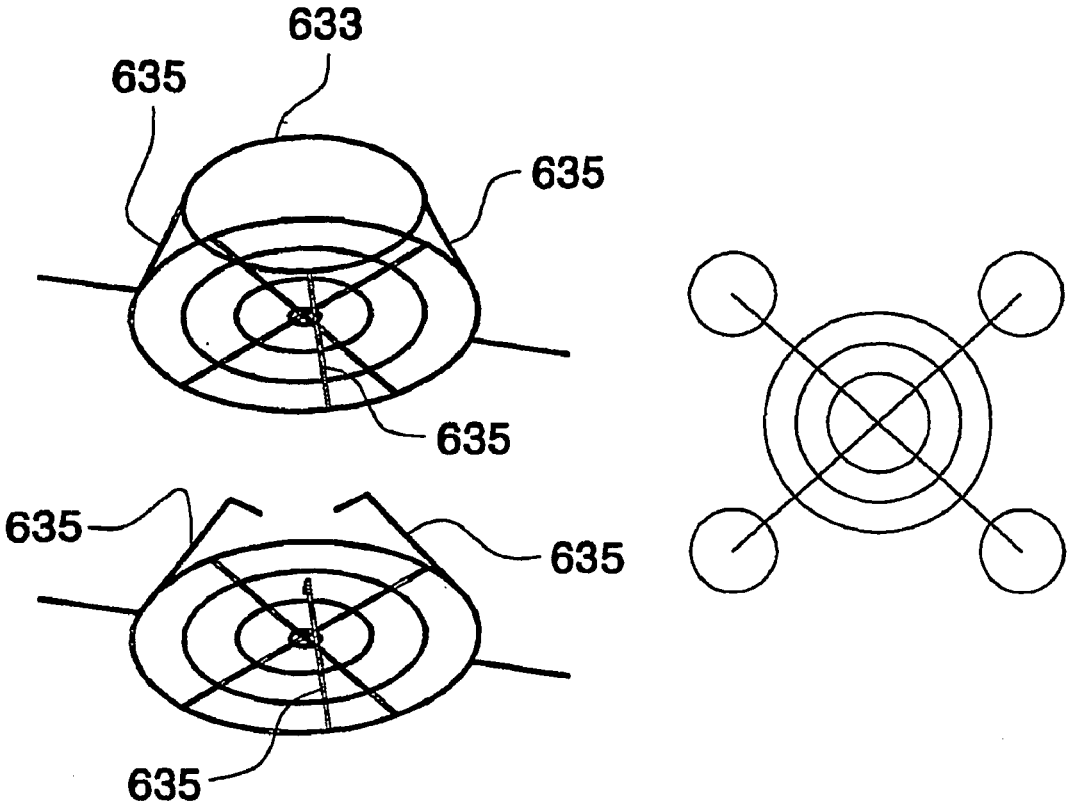
FIG. 30 shows embodiments of a pressing wire frame installed on a bottle body escape preventer.

FIG. 30 shows embodiments of a pressing wire frame installed on the bottle body escape preventer.

The pressing wire frame may be constructed only by a plurality of upper pressing bars 635 connected at a predetermined angle onto the bottle body escape preventer 730 or by connecting an upper pressing member 633 to the upper pressing bars 635. The upper pressing bars 635 or the upper pressing member 633 comes into contact with an inner surface of the door and thus resiliently presses down the bottle body escape preventer 730 when the door is closed.

Figure 31:
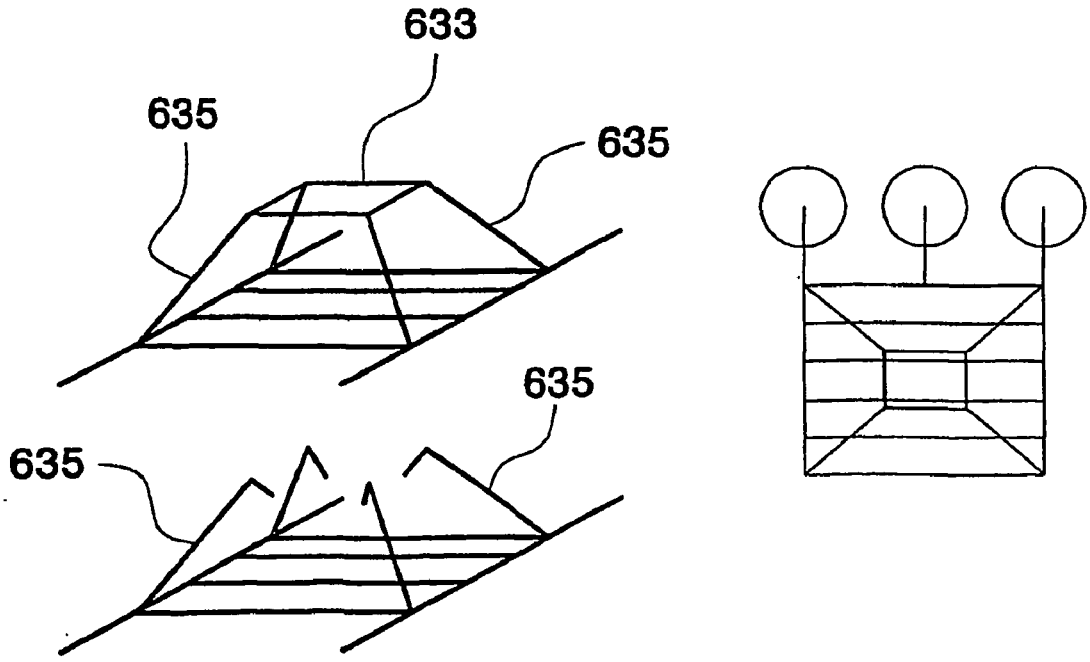
FIG. 31 shows the other embodiments of the pressing wire frame installed on the bottle body escape preventer.

FIG. 31 shows the other embodiments of the pressing wire frame installed on the bottle body escape preventer which takes, for example, the shape of a polygon.

Figure 32:
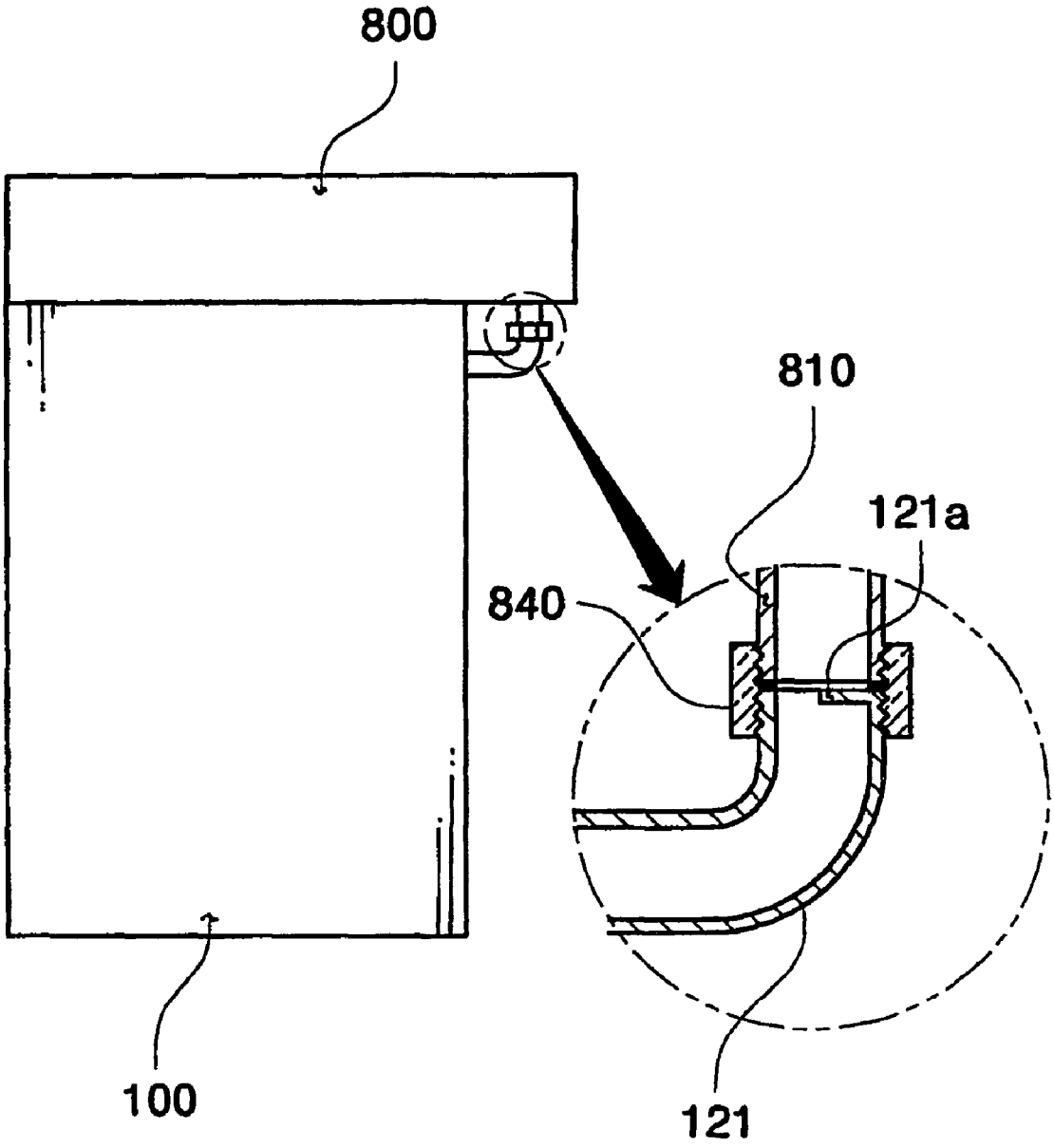
FIG. 32 is a side view showing a state where a supply water storage container is installed on a main body of the washing device for the baby bottle.

FIG. 32 is a side view showing a state where a supply water storage container is installed on the main body of the washing device for the baby bottle.

FIG. 32 shows a state where a water tap 121 protrudes from a rear surface of the main body and is in contact with an annular protrusion 810 formed around an outlet provided in the bottom of a supply water storage container 800 and a single nut 840 is screwed onto male threads formed on outer surfaces of both the annular protrusion 810 and the water tap 121.

Packing 811 is disposed at the bottom of the annular protrusion 810 to prevent leakage of the water.

Figure 33:
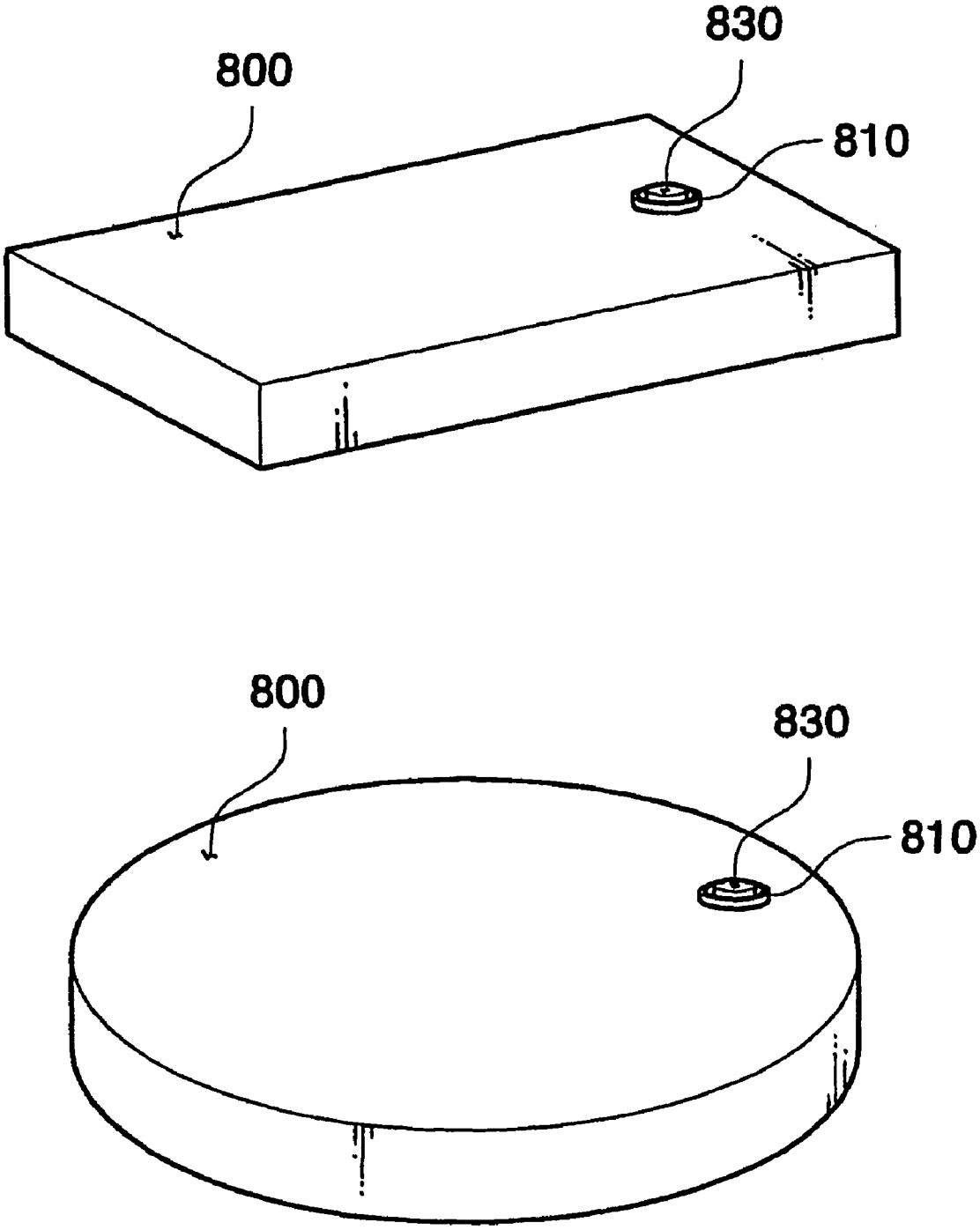
FIG. 33 is a perspective view of the supply water storage container.
Figure 34:
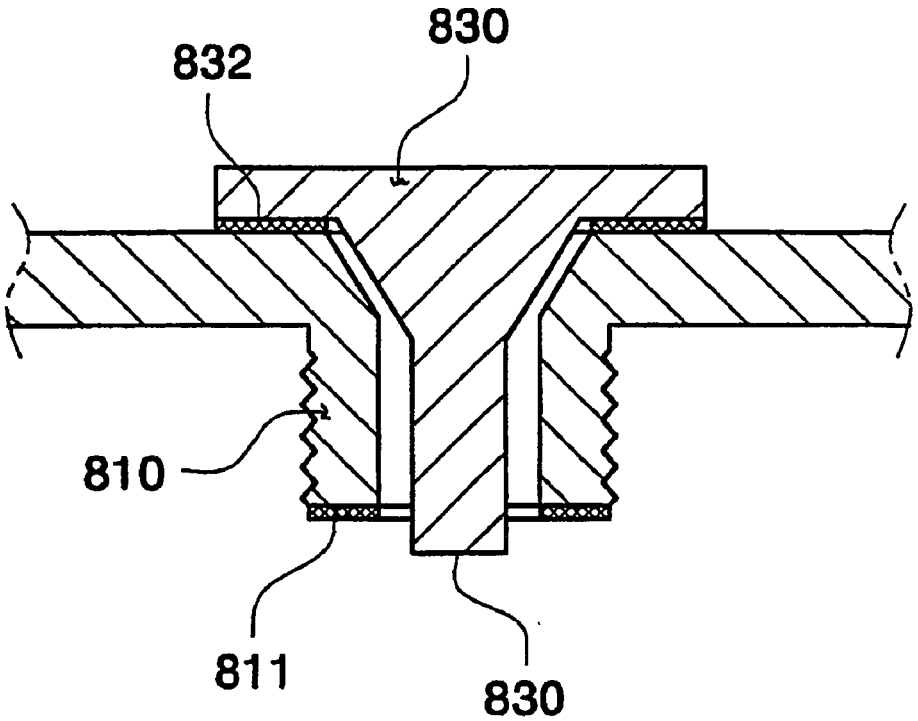
FIG. 34 is a schematic view showing an operating principle of a valve means of the supply water storage container.
Figure 34:
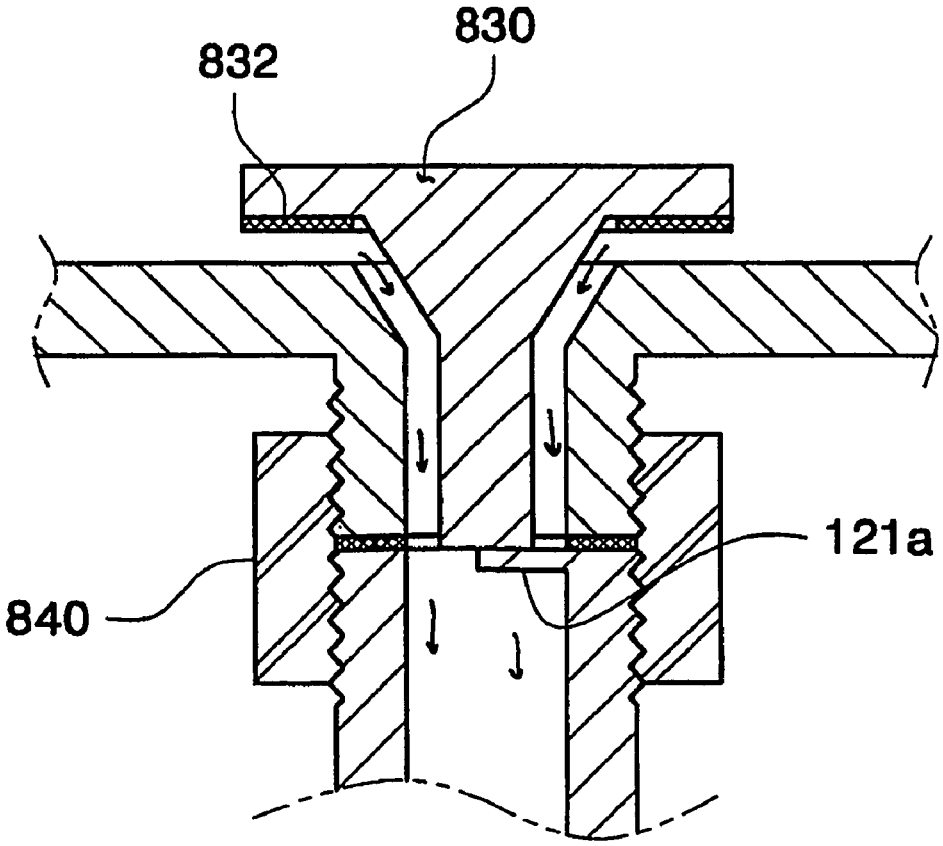

FIG. 33 is a perspective view of the supply water storage container. The supply water storage container 800 includes a valve 830 therein. The valve 830 generally takes the shape of a disk and has a protrusion 831 constructed to penetrate through the annular protrusion 810 formed around the outlet and rubber packing 832 attached around the protrusion 831. The supply water storage container 800 has an inner space for containing the water therein. A floor of the supply water storage container 800 is inclined to be raised in a direction away from the outlet so that the water can easily run out therefrom. When the water is contained in the supply water storage container, the valve 830 prevents the water from running out since the rubber packing 832 of the valve is in close contact with a portion around the outlet. When the supply water storage container is placed on the main body, the valve is lifted up in the supply water storage container by a boss 121*a* formed within the water tap 121 and thus the water contained in the supply water storage container is supplied into the water tap 121, as shown in FIG. 34.

Figure 35:
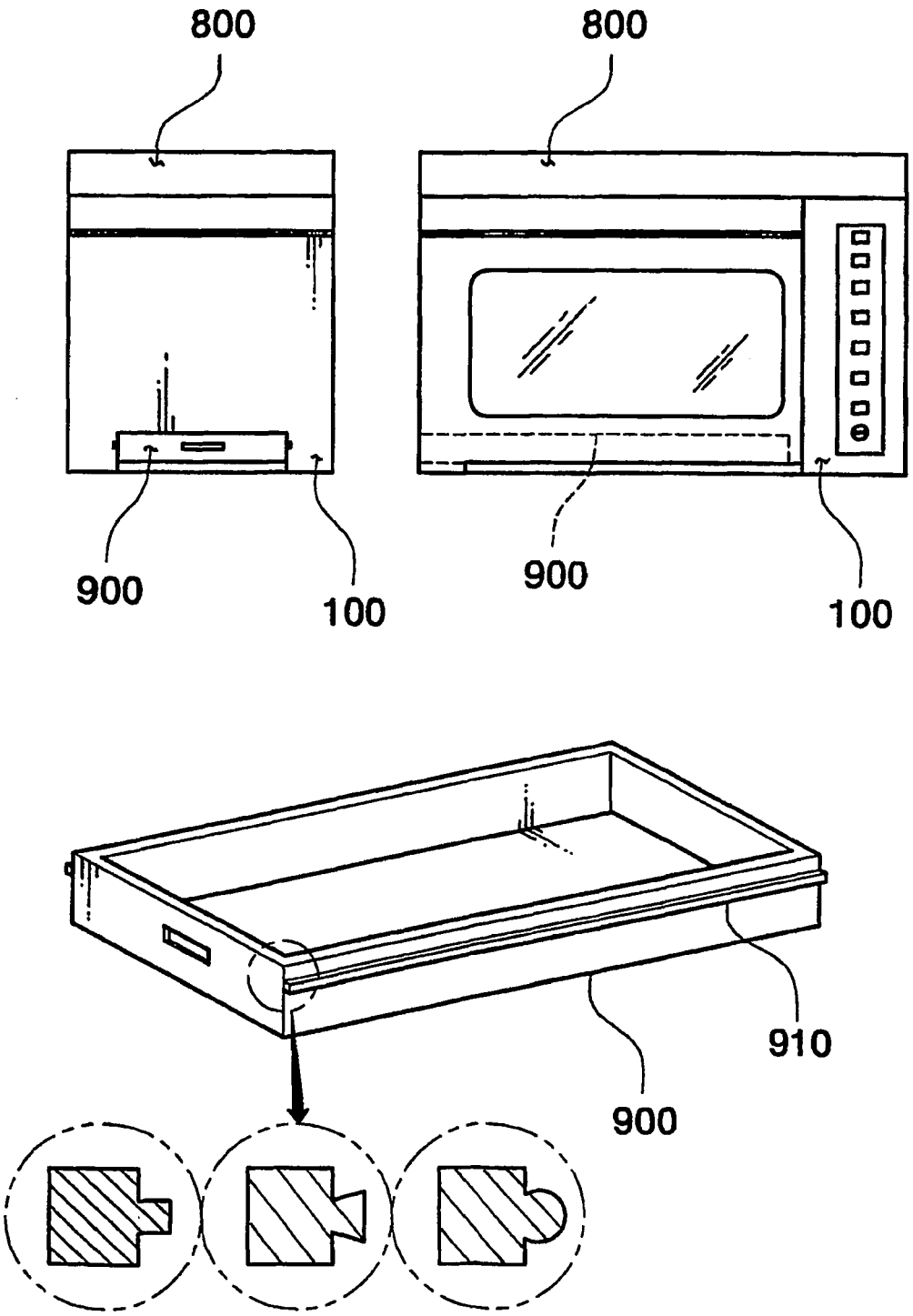
FIG. 35 shows an installed state of a drain water collection container installed on the main body of the washing device for the baby bottle.

FIG. 35 shows an installed state of a drain water collection container installed on the main body of the washing device for the baby bottle. A drain water collection container 900 has an inner space for containing the water that has been used for the washing of the baby bottles. Further, the drain water collection container has ledges formed on both side surfaces thereof and lower surfaces of the main body 100 facing both the side surfaces of the drain water collection container are provided with grooves for receiving the ledges therein so that the drain water collection container can be accommodated in a lower portion of the main body 100 in a drawer fashion. On the contrary, the grooves may be formed in the side surfaces of the drain water collection container and the ledges may be formed on the lower portion of the main body. The ledges may have a rectangular, trapezoidal or arc-shaped cross section.

The washing device for the baby bottle according to the present invention may further comprise a voltage changer for allowing use of a battery as a power supply in a case where the baby bottles are to be washed by using the washing device having the supply water storage container, the drain water collection container and the like at the outdoors on which the electric power is not supplied.

INDUSTRIAL APPLICABILITY

According to the present invention, there is provided a new washing device for a baby bottle which can automatically wash a bottle body, a nipple and a nipple cap of the baby bottle.

Further, according to the present invention, since there is provided a washing device for a baby bottle which can dry and sterilize the baby bottle after washing thereof, the baby bottle can be used sanitarily.

Moreover, according to the present invention, there is provided a convenient and sanitary, portable washing device for a baby bottle since the baby bottle can be washed with only water, even outdoors.

Furthermore, according to the present invention, the baby bottle can be washed stably since there is provided a fixture capable of holding a bottle body or a nipple cap of the baby bottle to prevent them from being moved when the baby bottle is washed by injecting a washing liquid under high pressure.

In addition, since the nozzle tube for injecting the washing liquid toward upper, middle and lower portions of the bottle body accommodated in the baby bottle washing chamber is integrally formed, the nozzle tube can be installed in a simple manner.

It should be understood that the embodiments of the present invention described above and illustrated in the drawings is not construed as limiting the technical spirit of the present invention. The scope of the invention is defined only by the appended claims, and those skilled in the art can make various changes and modifications to the embodiments of the present invention within the scope of the invention. Thus, such changes and modifications fall within the scope of the invention as far as they are obvious to those skilled in the art.

The invention claimed is:

1. A washing device for a baby bottle, comprising:

a main body having a baby bottle washing chamber capable of accommodating bottle bodies, nipple caps and nipples of a plurality of baby bottles therein, and formed with a supply port for supplying a washing liquid into the baby bottle washing chamber and a drain port for draining the washing liquid to exterior thereof after washing of the baby bottles;

a door installed in the main body to be opened and closed for allowing the baby bottles to be introduced into and removed from the baby bottle washing chamber;

a plurality of injection nozzles installed within the baby bottle washing chamber so that the washing liquid can be injected toward the accommodated bottle bodies, nipple caps and nipples;

a pump for supplying the washing liquid to the plurality of injection nozzles at a high pressure;

a motor for driving the pump;

a nozzle tube connecting the plurality of injection nozzles to a discharge port of the pump and installed within the baby bottle washing chamber of the main body;

a washing liquid mixing chamber connected to a suction port of the pump to supply the washing liquid to the pump and having a washing liquid mixing plate therein for mixing a detergent and water supplied through a washing liquid inlet thereof;

a detergent storage container connected to the washing liquid inlet of the washing liquid mixing chamber;

a water tap connected to the washing liquid inlet of the washing liquid mixing chamber;

a detergent adjustment valve for adjusting supply of the detergent from the detergent storage container to the washing liquid mixing chamber;

a water supply adjustment valve for adjusting supply of the water from the water tap to the washing liquid mixing chamber; and a control unit for controlling operations of the motor, the detergent adjustment valve and the water supply adjustment valve individually or in a predetermined sequence.

2. The washing device as claimed in claim 1, further comprising a plurality of bottle body supports for holding the bottle bodies in such a state where mouths of the plurality of the bottle bodies are spaced apart by a predetermined distance from and directed to the floor of the baby bottle washing chamber, and an auxiliary support having a plane for allowing the plurality of nipples and nipple caps to be aligned in one direction and accommodated therein, wherein the plurality of nozzles includes a plurality of first nozzles installed on the floor of the main body for washing the interiors of the plurality of bottle bodies and a plurality of second nozzles for washing outer surfaces of the bottle bodies, the nipple caps and the nipples.

3. The washing device as claimed in claim 2, wherein the floor of the main body is inclined to be raised in a direction away from the drain port so that the washing liquid can be easily drained therefrom.

4. The washing device as claimed in claim 2, wherein the front face of the main body is formed with a viewing window made of material that allows view of the interior of the baby bottle washing chamber.

5. The washing device as claimed in claim 2, wherein the plurality of first nozzles extend above first insertion rings of the plurality of bottle body supports.

6. The washing device as claimed in claim 2, wherein some of the injection nozzles are rotary nozzles.

7. The washing device as claimed in claim 2, wherein a portion of the washing liquid mixing plate is formed with a plurality of through-holes.

8. The washing device as claimed in claim 2, wherein each of the bottle body supports comprises a plurality of bottle body supporting units each of which includes a first insertion ring, a second insertion ring having a diameter larger than that of the first insertion ring, and an insertion ring supporting member for connecting the first and second insertion rings to support the first and the second insertion rings with a predetermined gap therebetween in parallel; the plane of the auxiliary support for separately accommodating the nipple caps and the nipples is divided into a plane for accommodating the nipple caps and a plane for accommodating the nipples; the plurality of the bottle body supporting units and the auxiliary support comprise wire frames through which the injected liquid can pass; and the bottle body supporting units are coupled integrally with the auxiliary support.

9. The washing device as claimed in claim 8, further comprising a bottle body escape preventer including a wire frame plate detachably seated onto the auxiliary support and a plurality of pressing bars which are formed by extending some wires of the wire frame plate and press down the bottoms of the bottle bodies.

10. The washing device as claimed in claim 9, further comprising a pressing wire frame which is connected to an upper surface of the wire frame plate of the bottle body escape preventer and comes into contact with the door when the door is closed, thereby pressing down the bottle body escape preventer.

11. The washing device as claimed in any one of claims 2 to 10, further comprising a heater for heating air to dry the plurality of washed bottle bodies, nipple caps and nipples, a blower for blowing the heated air into the baby bottle washing chamber, and an air tube for guiding the air blown by the blower into the baby bottle washing chamber, wherein the main body is further formed with a hole for accommodating the air tube and the control unit further includes a function of controlling the blower and the heater.

12. The washing device as claimed in claim 11, further comprising an ultraviolet lamp installed within the baby bottle washing chamber of the main body to sterilize the plurality of the bottle bodies, nipple caps and nipples accommodated in the baby bottle washing chamber, wherein the control unit further includes a function of adjusting turning on and off of the ultraviolet lamp.

13. The washing device as claimed in claim 12, wherein the predetermined control sequence performed by the control unit comprises the step of selecting a detergent washing process or a water washing process; the detergent washing process comprises the steps of performing water washing by opening the water supply adjustment valve for a predetermined period of time and operating the pump, performing detergent washing by opening the water supply adjustment valve and the detergent supply adjustment valve for a predetermined period of time and operating the pump, performing again the water washing by opening the water supply adjustment valve for a predetermined period of time and operating the pump, and performing sterilization by turning on the ultraviolet lamp for a predetermined period of time; and the water washing process comprises the steps of performing water washing by opening the water supply adjustment valve for a predetermined period of time and operating the pump, performing drying by operating the heater and the blower for a predetermined period of time, and performing sterilization by turning on the ultraviolet lamp for a predetermined period of time.

14. The washing device as claimed in claim 13, wherein the control sequence further comprises the step of performing drying by operating the heater and the blower for a predetermined period of time between the steps of performing the water washing and the sterilization of the detergent washing process.

15. The washing device as claimed in claim 13, wherein the control sequence further comprises the step of performing drying by operating the heater and the blower for a predetermined period of time between the steps of performing the water washing and the sterilization of the water washing process.

16. The washing device as claimed in any one of claims 12 to 15, further comprising a supply water storage container in the form of a tank capable of containing a predetermined amount of water therein which can be detachably installed onto the main body, is formed at the bottom thereof with an outlet for allowing the water to run out, and has a valve means for allowing the water contained in the supply water storage container to run out into the water tap when the supply water storage container is installed onto the main body.

17. The washing device as claimed in claim 16, wherein the valve means of the supply water storage container includes:

a valve plate which is positioned within the supply water storage container, takes the shape of a disk capable of closing the outlet of the supply water storage container, and has a protrusion on a surface of the valve plate directed toward the outlet to penetrate through the outlet, and rubber packing attached around the protrusion; and a boss protruding from an inner surface of the water tap connected to the washing liquid inlet.

18. The washing device as claimed in claim 17, further comprising a drain water collection container in the form of a tank capable of accommodating a predetermined amount of water therein which includes an opening formed at the top thereof for receiving the washing liquid drained from the drain port of the main body and a means for allowing the drain water collection container to be detachably installed at a lower portion of the main body.

19. The washing device as claimed in any one of claims 2 to 10, further comprising a supply water storage container in the form of a tank capable of containing a predetermined amount of water therein which can be detachably installed onto the main body, formed at the bottom thereof with an outlet for allowing the water to run out, and has a valve means for allowing the water contained in the supply water storage container to run out into the water tap when the supply water storage container is installed onto the main body.

20. The washing device as claimed in claim 16, wherein the valve means of the supply water storage container includes:

a valve plate which is positioned within the supply water storage container, takes the shape of a disk capable of closing the outlet of the supply water storage container, and has a protrusion on a surface of the valve plate directed toward the outlet to penetrate through the outlet, and rubber packing attached around the protrusion; and a boss protruding from an inner surface of the water tap connected to the washing liquid inlet.

21. The washing device as claimed in claim 20, further comprising a drain water collection container in the form of a tank capable of accommodating a predetermined amount of water therein which includes an opening formed at the top thereof for receiving the washing liquid drained from the drain port of the main body and a means for allowing the drain water collection container to be detachably installed at a lower portion of the main body.

* * * * *